US007588002B2

(12) United States Patent
Wygnanski et al.

(10) Patent No.: US 7,588,002 B2
(45) Date of Patent: Sep. 15, 2009

(54) PROGRAMMABLE HIGH SPEED VALVE ACTUATOR AND POWER SUPPLY THEREFOR

(75) Inventors: Wladyslaw Wygnanski, Cambridge (GB); Graham Paul Ford, Cambridge (GB)

(73) Assignee: Camcon Ltd., Cambridge (GB)

( * ) Notice: Subject to any disclaimer, the term of this patent is extended or adjusted under 35 U.S.C. 154(b) by 601 days.

(21) Appl. No.: 11/248,072

(22) Filed: Oct. 11, 2005

(65) Prior Publication Data

US 2008/0035870 A1 Feb. 14, 2008

Related U.S. Application Data

(63) Continuation-in-part of application No. PCT/GB2004/001762, filed on Apr. 26, 2004.

(60) Provisional application No. 60/670,433, filed on Apr. 12, 2005.

(30) Foreign Application Priority Data

Apr. 26, 2003 (GB) ..... 0309512.2
Dec. 17, 2003 (GB) ..... 0329201.8

(51) Int. Cl.
*F01L 9/04* (2006.01)

(52) U.S. Cl. ..... 123/90.11; 251/129.15

(58) Field of Classification Search ..... 123/90.11; 251/129.15, 129.19; 701/36
See application file for complete search history.

(56) References Cited

U.S. PATENT DOCUMENTS 5,331,931 A 7/1994 Blish
5,873,335 A * 2/1999 Wright et al. ..... 123/90.11
6,443,135 B1 9/2002 Dismon

FOREIGN PATENT DOCUMENTS

DE 3606722 A1 9/1987
DE 19825964 A1 12/1999
DE 19860451 A1 6/2000

(Continued)

*Primary Examiner*—Zelalem Eshete
(74) *Attorney, Agent, or Firm*—Barnes & Thornburg LLP

(57) ABSTRACT

An electromagnetic actuator is described in which a rotor comprising permanent magnet means is rotatable in a stator which is magnetisable by causing an electric current to flow through at least one winding associated with the stator. The rotor has at least two stable rest positions, each defined by spring and/or magnetic forces acting on the rotor. Spring means stores energy during part of the movement of the rotor and provides kinetic energy for accelerating the rotor during subsequent movement thereof away from rest in one position towards another. A magnetic torque is exerted on the rotor when a current flows in said at least one winding which is sufficient to overcome the force(s) holding the rotor in that rest position, to cause the rotor to rotate in a direction from that rest position towards another a rest position. The rotor is connected to a thrust member by a mechanical linkage by which the rotational movement of the rotor is converted into substantially linear movement. The linkage has a mechanical advantage which varies in a predetermined manner during the rotation of the rotor. The actuator can be used to open and close a valve of an internal combustion engine. A power supply is provided for delivering current to the actuator from a current source so as to operate the actuator in an energy efficient manner.

20 Claims, 20 Drawing Sheets

FOREIGN PATENT DOCUMENTS

Figure 1:
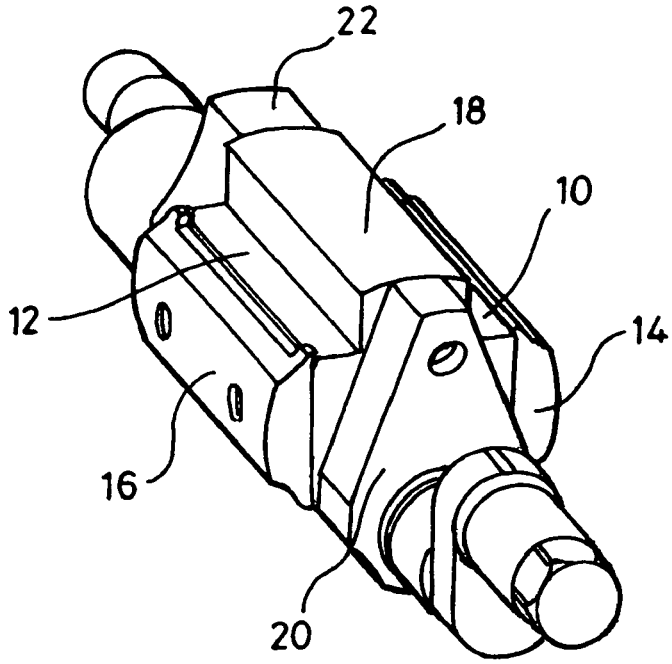

| | | | |
|---|---|---|---|
| DE | 10140461 | A | 2/2003 |
| EP | 0603929 | A | 6/1994 |
| EP | 1091112 | A | 4/2001 |
| JP | 2001/152820 | A | 6/2001 |
| WO | WO-02/25152 | A | 3/2002 |
| WO | WO-02/084082 | A1 | 10/2002 |
| WO | WO-03/016683 | A | 2/2003 |

* cited by examiner

"ON" mode

"OFF" mode

"Brake" mode

"Stop" mode
(instant stop by reversed torque)

PROGRAMMABLE HIGH SPEED VALVE ACTUATOR AND POWER SUPPLY THEREFOR

This application is a continuation-in-part of co-pending International Application No. PCT/GB2004/001762, filed Apr. 26, 2004, and is also the nonprovisional filing of Provisional Application No. 60/670,433, filed Apr. 12, 2005.

FIELD OF THE INVENTION

This invention concerns magnetic actuators, especially electromagnetically triggered devices. The invention is of particular use in a device for opening and closing a poppet valve.

BACKGROUND TO THE INVENTION

Poppet valves are used to control the flow of fluids and as such have been proven to offer a robust method of controlling and sealing fluids that are aggressive, for example where the fluids have high temperatures and pressures. In particular, poppet valves usually operated by rotating cams operating to overcome springs which act in a manner to close the valves have been employed to control the flow of air or air and fuel mixtures into, and the exit of the products of combustion from, the combustion chambers of internal combustion engines.

By careful selection of the cam profile, it is possible to make small changes to the manner in which the valve closure approaches the valve seat and the manner and rate at which the closure moves between closed and open positions, and vice versa, quite apart from the times for which the valve is actually open and closed. This pattern of movement of the closure will be referred to as the valve movement profile.

Where the cams are rotated by the engine, it is in general impossible to alter the valve movement profile as between one engine speed or loading and another. However it has been long recognised that greater efficiency can be achieved if a different valve movement profile is employed at different speeds or loadings. But where mechanically driven cams are concerned with fixed cam profiles, the latter have to be selected to give the best compromise valve movement profile over the expected range of engine speeds and loadings.

It is common practice to define the cam profile in order to ensure that the landing speed of the valve closure is a small fraction of the maximum velocity of the valve, in order to reduce impact stress on the valve seating on closure, while providing a high speed movement of the valve closure on opening and at other parts of its travel.

When running an engine at high speed there is a need to operate poppet valves with high levels of acceleration and deceleration, and it is often found that the forces generated by push-rods, cams or springs are a limiting factor on the speed at which an engine can be run.

In an attempt to better control the opening and closing of inlet and exhaust valves of an internal combustion engine and in particular vary the valve movement profile at different operating speeds, it has already been proposed to replace the cams by electromagnetic solenoid actuators driven by electric current from a computer controlled engine management system. But hitherto the results have been less than satisfactory. Thus, when used to open and close such valves at high speeds, solenoid actuators have been found to produce high landing speeds and the control systems cannot regulate the kinetic energy of the valves as operating speeds increase. Furthermore, electromagnetic solenoid actuation does not achieve speeds of valve operation required of inlet and exhaust valves of the combustion chambers containing the pistons of an internal combustion engine designed to run at high speeds.

It is an object of the present invention to provide a magnetic actuator better suited to control the opening and closing of the inlet and exhaust valves of an internal combustion engine.

It is also an object of the invention to provide a power supply for operating the actuator in an energy efficient manner.

SUMMARY OF THE INVENTION

The present invention provides an electromagnetic actuator in which a rotor comprising permanent magnet means is rotatable in a stator which is magnetisable by causing an electric current to flow through at least one winding associated with the stator, the rotor being rotatable between stable rest positions defined by spring and/or magnetic forces acting on the rotor, wherein spring means store energy during part of the movement of the rotor and provide kinetic energy for accelerating the rotor during subsequent movement thereof away from one rest position towards another, wherein a magnetic torque is exerted on the rotor when a current flows in said at least one winding which is sufficient to overcome the force(s) holding the rotor in that rest position, to cause the rotor to rotate in a direction from that one rest position towards another rest position, the rotor being connected to a thrust member by a mechanical linkage by which the rotational movement of the rotor is converted into substantially linear movement, the linkage having a mechanical advantage which varies in a predetermined manner during the rotation of the rotor.

In a preferred embodiment, the rotor has only two stable rest positions, each of which is defined by of magnetic and/or spring forces acting on the rotor, wherein a first spring means stores energy during movement of the rotor towards one rest position and provides kinetic energy for accelerating the rotor away from that rest position towards its other rest position, and a second spring means stores energy as the rotor rotates towards its other rest position to provide kinetic energy to provide an accelerating force on the rotor as it moves away from the said other rest position in a reverse sense back towards its first rest position.

This mechanical advantage variation will be referred to as the mechanical advantage profile of the actuator. Typically the profile will be non-linear. In one arrangement, the mechanical advantage alters pseudo-sinusoidally with the angular movement of the rotor, but is modified such that near one rest position angular movement of the rotor results in substantially no linear movement of the thrust member.

Using a varying mechanical advantage drive between rotor and thrust member allows a non-linear relationship between rotor movement and thrust member movement.

The stator preferably has an even number of poles, and the rotor has an even number of nodes which are magnetised alternately North and South around the rotor by the permanent magnet means.

Preferably the magnetic force acting to retain the rotor in any of its rest positions due to magnetic energy alone coincides with rest positions formed by the spring means.

Preferably the rest positions correspond to positions in which nodes and poles are aligned.

Around each of the poles of the stator there is an electrical winding which when energised by an electric current produces a magneto-motive force on the rotor. The windings are energised in succession with pulses of current, timed to correspond to the rotational position of the rotor and the required torque.

Preferably the stator has eight spaced apart electromagnetically polarisable poles and the rotor has four spaced apart permanently magnetised nodes. Preferably the poles and nodes are equally spaced apart.

When employed to open and close an inlet or exhaust valve of an internal combustion engine, the rest position corresponding to the valve closed position will be referred to as the primary rest position. The mechanical advantage profile is arranged to produce a high mechanical advantage at the rotational position at which the valve begins to open. After initial opening of the valve the profile is such that the mechanical advantage reduces and then increases again until the valve is fully open. The mechanical advantage again decreases to another minimum and rises as the rotor is rotated towards its original primary rest position and the valve nears its original closed position, through which the rotor continues to rotate without further movement of the valve until the rotor is again in its primary rest position.

By using a drive having a varying mechanical advantage it is possible to reduce the landing speed on closure to a low level, reducing wear on the valve and valve seat as well as noise.

By using a drive having a varying mechanical advantage it is also possible to maximise the force acting on the valve which is required to overcome the gas pressure forces acting on the closure due to residual gas pressure within the combustion chamber after a firing stroke of the engine is completed and the chamber is to be exhausted ready to receive the next charge of fuel and air.

If the mechanical advantage profile of the drive allows for some rotational movement of the rotor from its primary rest position to occur without any consequential linear movement of the valve, the connection to the valve closure can be thought of as possessing some lost motion which enables the rotor initially to rotate with little resistance to motion through a small angle before force is to be applied to the thrust member acting on the valve.

Lost motion between the drive and the thrust member, or the latter and the valve closure will be taken up during initial movement.

During the two crankshaft revolutions making up the operating cycle of a 4 stroke engine, any one of the valves will usually be opened for between 200 to 290 degrees of crankshaft rotation, and remain closed for the rest of the cycle, so that the valve undertakes a complete open and close sequence once every 720 degrees of crankshaft rotation.

By employing a linkage with varying mechanical advantage and a dwell or lost motion period during which the valve remains closed while the rotor is still free to move, the rotor will move over a longer period of time than that for which the valve is open. For a given electromagnetic actuator electrical driving torque and rotational inertia, this allows the valve to open and close in a shorter time and therefore allows the engine to run faster for a given valve opening crankshaft angle.

A single spring may store mechanical energy when the rotor is in its primary rest position, when the valve is closed. The spring may comprise a resilient cantilevered spring arm the free end of which presses on the outer circumference of an eccentric which rotates with the rotor and in doing so will deflect the arm and store energy therein in so doing. The angular position of the eccentric relative to the rotor is such that as the valve opens energy is released from the spring, assisting the rotor to accelerate to open the valve and as the valve closes, the eccentric again deflects the spring arm so that energy is once again stored therein, which causes the rotor to decelerate towards the primary rest position.

The valve is fully open when the spring is in its most relaxed or least deflected position. This position is referred to as a secondary rest position.

The torque generated by the ripple of stored magnetic energy from the permanent magnet means as the rotor rotates produces a so called magnetic cogging torque. If this magnetic cogging torque is substantial, there can be several secondary rest positions for the rotor and therefore the valve.

Where the valve is one of the valves of an internal combustion engine and each valve is operated by an actuator as aforesaid, the valves can be rotated through different angular extents to suit the different operating conditions of the engine by injecting holding currents into the winding(s).

The operation of the spring means provides for energy recycling and allows the actuator to operate at high speed with less electrical energy input than if a conventional solenoid actuator were to be employed with the same inertia and speed.

The motion of the valve closure (poppet) when the engine is operating at high speed can be likened to interrupted oscillatory motion and the spring means provided by the invention absorbs energy from the oscillatory motion of the closure and from the oscillatory rotor movement.

In a four-stroke internal combustion engine, the gas forces on the valve closure during the opening of a valve can vary as the load on the engine changes. This affects the amount of mechanical work that has to be done initially to release the valve from its closed position, although once the valve has opened the gas pressure quickly collapses and little further work has to be done to continue to move the closure away from the seat.

Preferably a control system is provided for supplying pulses of electrical energy to the winding(s) which operates to provide the required instantaneous electrical energy in each current pulse to control the phase (i.e. timing) and/or duration of each pulse in response to varying engine load, so as to generate sufficient magnetic torque at each instant during valve opening and closing to overcome the forces acting on the valve closure at that time in the cycle, and which can vary with load, crank angle and from cycle to cycle.

In a preferred embodiment the stator has eight poles, spaced equidistantly around the rotor, and the rotor has four equally spaced apart nodes magnetised by means of the permanent magnet means within the rotor, the rotor will normally rest generally aligned between a pair of adjacent stator poles, if the circumferential extent of each pole of the stator is of the order of half that of each rotor node. The lowest magnetic energy of the system occurs when the magnetic flux, induced by the permanent magnet means, is able to flow through the magnetic circuit with minimum resistance.

Initial movement is effected by a pulse of current to the winding(s), the direction of flow being such as to cause the rotor nodes to be repelled away from poles on one side of the nodes (the trailing side) and to be simultaneously attracted by poles on the other side of the nodes (the leading side). By reversing the direction of the current flow as the rotor nodes move just beyond the point of alignment with stator poles, driving torque continues to be exerted on the rotor, thereby accelerating the rotor.

To brake the rotor movement, the winding(s) may be short-circuited, causing induced current(s) to flow in the windings in an appropriate sense to the initiating pulse of current, so reversing the stator pole polarity and dissipating the kinetic energy of the rotor, linkage and valve system. This appears as heat in the windings. In addition or alternatively the control system may generate a similar (reverse) current flow, in order to reverse the direction of torque to decelerate and bring the rotor to rest at a rest position such as either its primary rest position or any other rest position required to control the flow of fluid through the valve.

In embodiments described above in which the rotor has only two stable rest positions, the spring means stores energy derived from movement of the armature when only little force is required to move the valve closure, and in general this is available to be released as soon as the armature moves out of an end of travel position.

When the rotor is in its position corresponding to when the valve is closed, the energy stored in the spring means is resisted by forces generated by the permanent magnet flux. This resistance is referred to as "cogging torque" and if the permanent magnet is sufficiently powerful no current flow is required to keep the rotor in that position. The same conditions can apply at the other end of the rotor travel when the valve is fully open and again cogging torque will operate and again depending on the strength of the permanent magnet, no current flow is necessary to hold the rotor in its rest position.

Thus the interaction of the permanent magnet flux and spring force creating the cogging torque serves to hold the rotor in its two end of travel positions so that no electrical power may be required to keep the rotor in either of these rest positions and the rotor and stator can be likened to a stepper motor having only two positions. If the permanent magnet flux is insufficient it can be reinforced by a standing current in the or each winding which is replaced by the current pulses during rotor movement.

Where the stator has four poles, arranged in two opposed pairs, and the rotor is a permanent magnet, the rotor will normally rest partly aligned with one pair of poles, and the initial movement is effected by a pulse of current causing the rotor to be repelled away from the partly aligned poles, and to assist in the rotational movement a similar pulse of current may be applied to the other winding(s) to produce a force of attraction between them and the rotor, so that the rotor is repelled from one pair and simultaneously attracted to the other pair of poles. By reversing the direction of the currents flowing in the windings as the rotor moves just beyond alignment with the said other pair of poles.

In an embodiment of the invention in which the rotor can rotate continuously in the same direction if desired, the actuator comprises:

a) a stator of eight circularly arranged, inward radially directed poles, each pole being wound with insulated conductor to produce an electromagnet means at each pole, b) a rotor that includes two pairs of diametrically opposed permanent magnet poles, with the magnetic sense alternating north-south-north-south around the rotor, so that with appropriate pulling the rotor is rotatable in either direction, c) a spring element that stores mechanical energy as the rotor rotates to a primary rest position, d) a pin, surrounded by a tubular wheel element, extending laterally from and parallel to but offset from the axis of rotation of the rotor, e) a first lever pivotally mounted about an axis parallel to the rotor axis, f) an arcuate slot in the first lever within which the wheel and pin are received in which the wheel can roll or slide relative to the slot and also transmit rotational movement to the lever with the mechanical advantage varying with the angular position of the rotor the extent to which the angular movement of the pin and wheel produces angular movement in the lever being determined by the shape of the slot, g) the first lever having a cross-pin joint for transmitting thrust externally of the actuator, h) a sleeve extending from the rotor which is in contact with a second lever, i) the second lever being formed with an arcuate contact surface so as to move the spring via a sliding spherical bearing means, such that the spring displacement is a function of the rotor angular position, j) the arcuate surface of the second lever providing for a primary rest position, such that a small angular displacement of the rotor either side of the primary rest position results in either no movement of the spring or a slight additional straining of the spring, and such that larger movements of the spring result in the spring progressively unloading until the rotor has moved substantially 180 degrees from the primary rest position, and k) a housing within which the stator, windings, rotor lever and spring are located, l) the housing providing bearing means for the rotor, the first lever and the second lever.

Preferably a current controlling system is provided for supplying pulses of current of controlled magnitude, direction and timing to each winding.

The pin and wheel and first lever slot connection may in part provide a lost motion connection between the rotor and the lever, at least during the start of the rotation of the rotor from its primary rest position and during the last part of the rotation before it returns to the primary rest position, after having rotated through 180 degrees first one way and then in the opposite direction by the same amount, or after rotating through a full circle of 360 degrees.

The pin may be attached to or formed integrally with the outboard end of a crank arm extending from a hub adapted to rotate about the rotor axis and the hub extends axially and is rotationally supported within a first bearing in the adjacent end of the housing. The other end of the rotor can extend co-axially to form a sheave in the form of an eccentrically located bearing the outer race of which is engaged by, and bears the contact force of, the second lever as the spring force presses it into contact therewith. An axial extension of the rotor beyond the sheave runs in a second bearing similar to the first bearing, both bearings providing support for the rotor, such that the rotor is constrained only to move rotationally in response to applied torques. The second bearing may be located in another housing.

Preferably the lever is pivotally attached to a rigid link which is itself attached to a stem of a poppet valve closure member which controls either the ingress of combustible gases into, or the exit of spent gases from, a combustion chamber of an internal combustion engine.

Preferably such an arrangement is adjusted so that when the valve is fully closed, the rotor is in a rest position and will remain in that position without the need for any current to flow through a stator winding.

The inertia of the system comprising rotor, the two levers, the spring and the valve is acted on by the force from the main spring. This inertia-spring system forms an oscillatory system with two rest positions, one when the rotor is in the primary rest position, when the valve is closed, and another approximately 180 degrees away from it, when the valve is open. The spring, working with the arcuate surface of the second lever, applies a restoring force when the rotor moves through a small angle away from the primary rest position. Larger angles of movement cause the rotor to move under the influence of the stored energy in the spring to the secondary rest position. The spring will generate significant inertia forces as the rotor is moved either side of this secondary rest position.

In both rotor positions the spring force acts on the inertia to produce oscillatory motion. The spring energy is selected to minimise the time of oscillation and reduce the peak electromagnetically induced torque to move the rotor in a required time.

In an embodiment of the invention in which the rotor has only two stable rest positions, the actuator comprises:

a) a stator with four circularly arranged, inwardly radially directed poles,
b) a rotor that includes a pair of diametrically opposed permanent magnet poles, and which is rotatable within the four stator poles through up to 180 degrees from one rest position to another at the two extremes of its travel,
c) a first spring element that stores mechanical energy as the rotor rotates into each of the two extremes of its travel,
d) a pin extending laterally from, and parallel to but offset from the axis of rotation of the rotor,
e) a lever linked to the pin and pivotally mounted for rotational movement about an axis also parallel to the rotor axis, for exerting thrust externally of the actuator,
f) an arcuate slot in the lever in which the pin is received in which it can slide relative to the slot and also transmit rotational movement to the lever, the extent to which angular movement of the pin produces angular movement of the lever being determined by the shape of the slot,
g) a second spring element that stores mechanical energy as the lever is rotated into each of the two extremes of its travel,
h) at least one winding which when an electric current flows therein will create alternate North and South poles around the four stator poles,
i) a housing within which the stator, winding(s), rotor, lever and springs are located, opposite ends of which provide bearings for the rotatable parts, and wherein
j) the shape of the slot is selected so that at one extreme position of the rotor travel, initial rotation of the rotor from that position towards the other results in relative sliding movement between pin and slot before continued rotation of the rotor results in increasing rotational drive being transmitted via the pin to the lever, so that the mechanical advantage during that initial rotor movement is substantially greater than the mechanical advantage over the remainder of the rotor travel.

Preferably a current controlling system is provided for supplying pulses of current of controlled magnitude, and/or direction and/or phase (i.e. timing) to the or each winding or each of the coils.

The pin and slot connection may in part provide a lost motion connection between the rotor and the lever, at least during the start of the rotation of the rotor.

The pin may be attached to or formed integrally with the outboard end of a crank arm extending from a hub adapted to rotate about the rotor axis, and the hub extends axially for support within a bearing in the adjacent end of the housing. The other end of the rotor can extend co-axially to be received in a similar bearing co-axial with the first bearing, but in the opposite end face of the housing, so that the rotor is constrained but free to rotate about the axis defined by the two bearings.

Preferably the lever is pivotally attached to a rigid link which itself is attached to a stem of a poppet valve closure member which controls either the ingress of gases into, or the exit of gases from, a combustion chamber of an internal combustion engine.

Preferably such an arrangement is adjusted so that when the valve is fully open or fully closed, the rotor is in a rest position and will remain stationary therein without the need for any current to flow through a winding. This is achieved by ensuring that the torque applied by the two spring elements to the rotor are balanced by the torque generated by magnetic attraction between the rotor poles and the stator poles in the rest positions.

Typically each winding comprises two separate coils, one coil for each stator pole, and the valve opening and closing therefore may be accomplished by a sequence of appropriate current pulses applied to each coil.

Preferably a pulse of current is applied to each of the four coils so as to completely overcome and create an opposite flux to the permanent magnet flux holding the armature in its rest position so as to cause the rotor to rotate towards its other rest position under the combined torque of the force due to the springs and that created by the electromagnetic forces now acting on the rotor.

In general the two rest positions will not be aligned with either pair of stator poles, so that initial movement of the rotor will be in a direction causing its two poles to move further out of alignment with one pair of stator poles towards a position in which they will align with the other pair of stator poles, in the manner of an electric motor. Once the rotor has moved just past the position of alignment with this other pair of poles, reversing the current in the four coils will create a motor torque on the rotor tending to continue its rotation in the same sense, until it has rotated into its other rest position, through approximately 180 degrees.

A point is reached in the rotation of the rotor when each spring torque will reduce to zero and no longer assist in rotating the rotor. Continued rotation of the rotor due to inertia and magnetic motor torque now begins to store energy in each spring albeit in an opposite sense, causing the rotor to slow down and eventually come to rest in its other rest position. This energy will be available on the return cycle to assist in accelerating the rotor as it starts to rotate back towards its previous position.

Preferably the position of zero torque occurs for both springs at the same point during each rotation of the rotor.

As with the first rest position, when the rotor is in its second rest position the torque thereon created by the permanent magnet flux will again be balanced by the torque exerted by the energy now stored in the two springs, albeit operating in an opposite sense. Therefore, as before, if the permanent magnet can provide all the force of attraction necessary, no holding current is required to flow in the coils.

Applying an appropriate pulse of current to the coils to upset this balance, overcome the "holding" magnet flux, and exert an opposite magnetic torque on the rotor, will combine with the energy stored in the springs to generate a net torque which will rotate the rotor out of the said second rest position back towards its first rest position.

Once again current pulses of appropriate magnitude and phase but opposite direction are applied to the coils as the rotor poles pass beyond the alignment position with the intermediate stator poles, in order to apply a further electromagnetic (motor) driving torque to the rotor. As before, rotation of the rotor back into its first rest position is resisted by the springs, which during the latter part of the return movement of the rotor are once again storing instead of releasing energy.

Movement of the rotor is transmitted to a valve closure (e.g. poppet valve stem) to move the latter, through the variable mechanical advantage mechanism. This mechanism is configured to provide minimal movement of the thrust member (i.e. very high mechanical advantage) during significant initial rotation of the rotor. However once the valve has cleared the seat the mechanical advantage can be reduced dramatically since the resistance to movement of the poppet valve closure drops significantly once the valve has been unseated and gas pressure reduced. Motor torque acting on the rotor during the remainder of its rotation to its other rest position is largely available to be stored in the springs to assist in rotating the rotor in reverse when the valve is to be closed.

As the rotor rotates back to close the valve, the mechanical advantage of the mechanism begins at a low level and increases as the rotor approaches its original rest position, but now in an opposite sense. The rotor and valve closure are therefore slowed down, resulting in a low "landing speed" which ensures that despite the considerable residual inertial energy in the rotor, the impact force as the valve closure seats is modest, the noise produced on landing is reduced and less damage is done to the closure or the seating.

The design of the pin and slot engagement means that valve closure occurs before complete rotation of the rotor into its original rest position. As the rotor continues to rotate towards its original rest position (with the valve closed), the rotor spring continues to store the remaining kinetic energy of the rotor. Once at rest, the cogging torque induced by the permanent magnet flux linking the rotor holds the rotor in that rest position, despite the now significant energy stored in and oppositely directed torque exerted by the rotor spring which is tending to rotate it out of that position. It should also be noted that as the rotor poles move closer to being fully aligned with the stator poles, the reluctance of the magnetic circuit increases dramatically to a maximum when they are aligned. This enhances the magnetic force acting on the rotor.

Preferably the pin is surrounded by a cylindrical roller, with a rolling bearing sandwiched between the pin and the roller.

The two springs serve to provide a mass-spring oscillatory mechanical system that assists in reducing the operating time of the valve. The rotor spring applies torque to the rotor so as to apply a restoring torque as the rotor moves out of its equilibrium (rest) position. The other spring, acting on the lever, applies a restoring force to the lever as the latter moves out of its equilibrium (rest) position. The relative strengths of these two springs are selected to minimise the time of oscillation and reduce the peak magnetic torque which would otherwise be required of the electromagnetic drive.

It is noted above that as and when the actuator is required to operate to open or close the valve, a pulse of electrical current is supplied to the stator winding (or windings if more than one winding is provided) to overcome the magnetic force holding the rotor in its last home position and allow the potential energy stored in the spring to be released, to accelerate the rotor and cause it to rotate towards its next home position.

A power supply is described herein which incorporates a control system for effecting control of the flow of current between a source of current and the stator winding.

Such a power supply may reduce the electrical energy requirements of the actuator and enable it to be operated from a 12V battery, such as is commonly found in motor vehicles to provide a source of energy for starting the engine.

According to a further aspect of the present invention, there is provided a power supply for delivering electric current to the stator winding of an actuator which in use operates to open and close a valve associated with a cylinder of an internal combustion engine, which comprises:

a source of electric current, such as a battery, a circuit including electrically operable switch means between the source and the stator winding by which the source is connected to the stator winding, a control system responsive to a signal from a position sensor associated with the actuator which tells the control system the instantaneous position of the rotor and to signals from an engine management system linked to the engine, current delivery means (driver means) in the control system which in use delivers operating current pulses of appropriate magnitude, polarity and duration to operate the switch means in the circuit linking the source and stator winding, a buffer electrical energy storage means which can be connected in parallel with the stator winding by operation of the switch means, to be charged or discharged as required, and programmable computer means in the engine management system or the control system or both, programmed to control the operation of the driver means and the delivery of the operating current pulses to the switch means, whereby in use the latter is opened and closed as required, as follows:

a) to allow current to flow from the source to the buffer storage means and stator winding, to release the rotor from a home position, and/or b) to allow current to flow from the stator winding to the buffer storage means to effect a gentle braking of the rotor, and/or c) to allow current to flow from the buffer to the stator winding in an opposite sense to the direction of current flow through the winding from the source in a) to arrest continued movement of the rotor, and/or d) to disconnect the stator winding from both the source and the buffer storage means when it is not necessary for energy to be supplied to the stator winding because the rotor is in a home position or is moving under the influence of energy stored in spring means associated with the actuator.

The buffer may comprise a capacitor, typically one having a large capacity so that it can absorb a large quantity of electrical energy. Typically an electrolytic capacitor is employed for this purpose.

The source typically comprises a re-chargeable lead acid or similar battery, such as is employed in motor vehicles to store electrical energy for operating the engine starter motor and other electrical equipment in the vehicle, and is charged in known manner from an alternator and rectifying circuit when the engine is running. By carefully controlling the energy required to drive the actuator a 12 volt battery based system can provide all the electrical power required.

Preferably the program causes the switch means to be operated so as to connect the capacitor, battery and stator winding in parallel when the rotor is to be moved out of a home position.

Typically the free position of the actuator when power is off; corresponds to the valve being seated, i.e. the valve is closed.

Preferably the capacitor is connected to the battery before the winding is connected, so that the capacitor charge is also available to act as a source of current for the winding as well as the battery, when the winding is connected thereacross.

When the engine management system calls for a valve which is currently closed to be opened, the program causes a short duration pulse of current to flow in the stator winding of the actuator of that valve. This releases the rotor which continues to rotate after the pulse terminates under the influence of the stored spring energy, to open the valve.

When the sensor indicates that the rotor is beginning to approach the position to which the valve is to be closed (which may be its other "home" position or a position ahead of that home position if the valve is only required to be partially opened), the program may operate the switch means to connect the battery and capacitor combination across the stator winding to produce one or more short duration pulses to slow the rotor as it approaches the target position. This can be used to prevent overrun of the rotor beyond its target position.

The program can also arrange for the capacitor to be connected across the stator winding so that the back emf generated in the stator winding by the rotation of the rotor will cause a current to flow into the capacitor to charge the latter, and thereby recover energy from the rotor movement and in doing so further slow down the rotor as it approaches the target position.

This can be very important when the valve closure is closing, since it can create a so-called soft landing for the valve closure against the seat.

The control system can therefore be employed to control the instantaneous velocity of the valve closure as it moves from open to closed and vice versa, which enables the valve to be opened for shorter or longer periods of time during each valve event, and where two or more valves are provided for the inlet or exhaust of a cylinder, enables one or both of the valves to be opened to achieve different throughputs of air or gaseous products of combustion.

Engine designers have been investigating the potential of valve actuation mechanisms leading to the development of camless engines for many years. There have been a number of obstacles to the introduction of these mechanisms including power consumption, control of valve seating velocity and integration of the mechanism with the engine structure and systems.

This further aspect of the invention provides so-called Intelligent Valve Actuation (IVA), using the rotary electromagnetic valve actuator described herein, which provides the following benefits over existing valve actuation technology:

Each valve can be fully independently controlled;

Valves can be latched at a number of lift positions, including fully closed, with zero power consumption;

Energy recovery leads the IVA mechanism to have low power consumption;

IVA provides low seating velocity ensuring durability and low noise.

The initial test work has provided a concept demonstration rig, with simulated cylinder gas forces, which has demonstrated the capability of IVA to run at an equivalent crankshaft speed of 8000 rev/min. The IVA rig testing results are presented and indicate the potential of the system being developed for single/multi cylinder IC engine application.

Precise control over combustion has become key in developing high efficiency low emissions engines. Developments in cylinder head design, intake charge motion devices and fuel systems have reached the point where configurable and precise control over valve events has become key in developing new combustion system technology. In conventional valvetrains the mechanical relationship between valve, camshaft and crankshaft limits the flexibility of the control of combustion events. Existing mechanical variable valve control mechanisms provide some additional flexibility in valve events, but with additional cost and weight, and only within rigid mechanically set limits. Although camless engine technology has been demonstrated in a research environment the systems currently in the public domain are large and complex with higher power consumptions.

IVA provided by the invention provides a compact, low cost, low power consumption system providing full control over poppet valve actuation, thus creating significant opportunities for developing advanced combustion systems providing improved engine performance and emissions.

The compact nature of IVA, along with its low power consumption, reduces the complexity of engine integration and allows the use of a conventional 12 volt operating system.

Additionally the combination of actuator and software programmable control system proposed herein can enable poppet valve disablement, variable swirl, variable lift and variable opening/closing duration.

IVA hence creates opportunities in:

Improved engine combustion efficiency;

Improved evaporative emissions;

Cycle by cycle cylinder de-activation.

The IVA system proposed by the invention is based around the multi-pole rotary actuator (similar in appearance to a motor) providing a variable rotational displacement, driving a mechanism and giving full poppet valve control in duration and lift.

Embodiments of the invention will now be described by way of example with reference to the accompanying drawings in which:—

Figure 2:
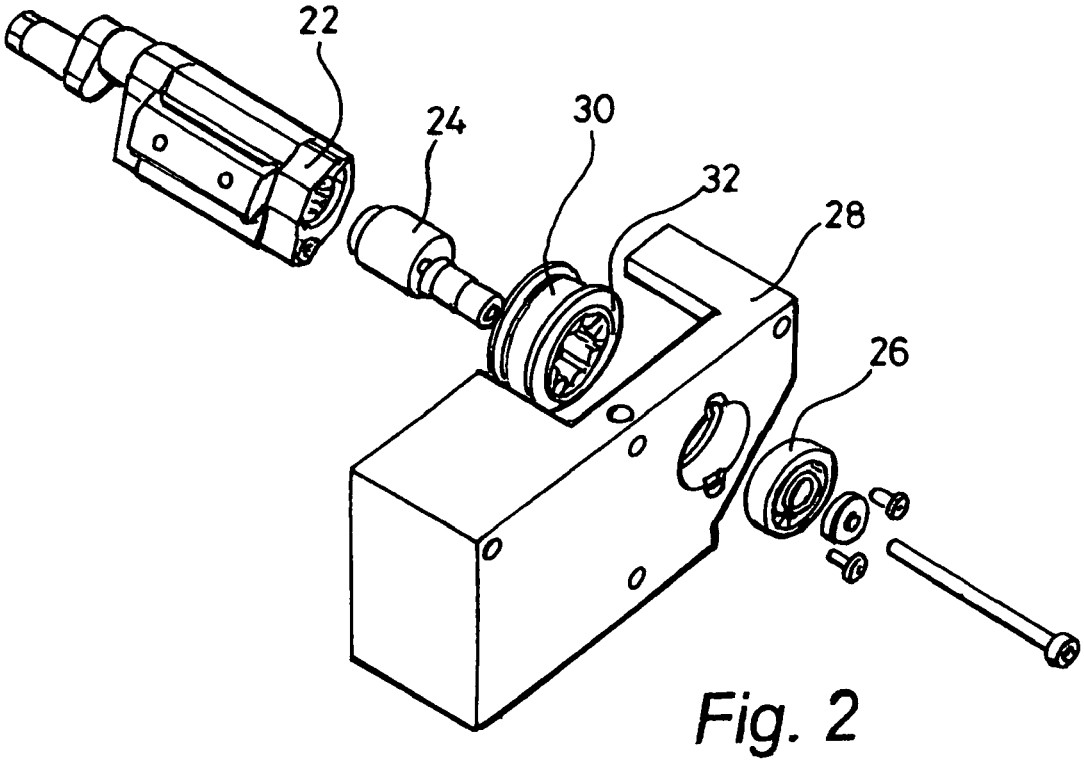
Figure 3:
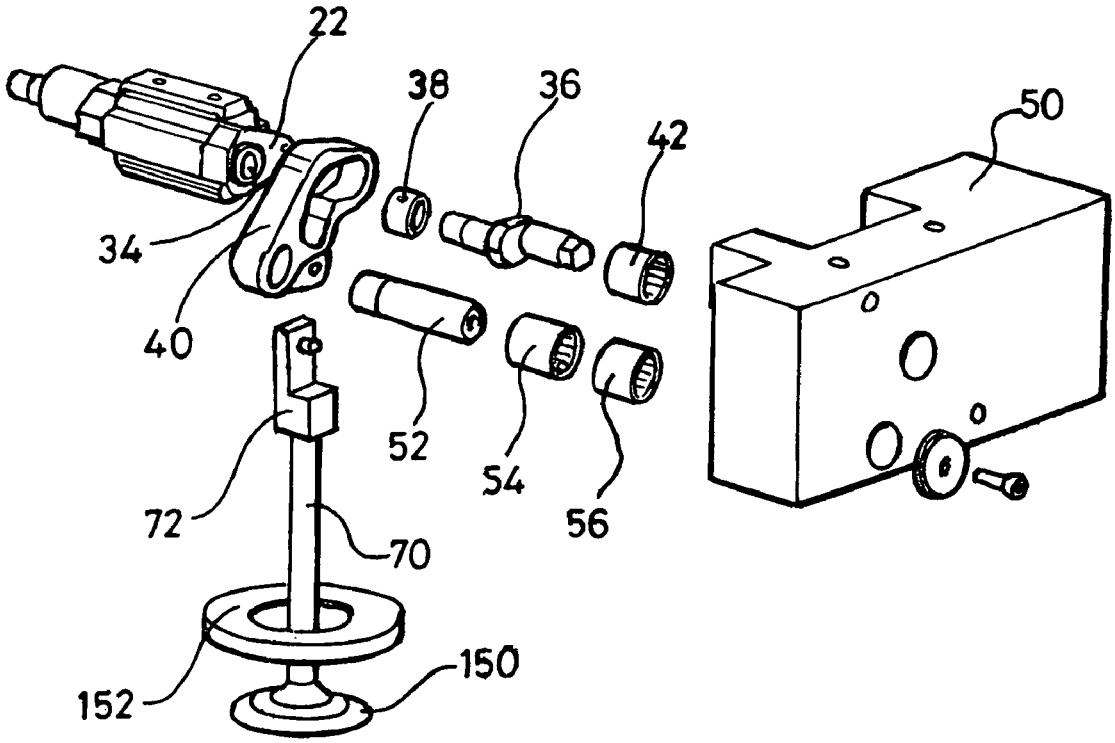
Figure 4:
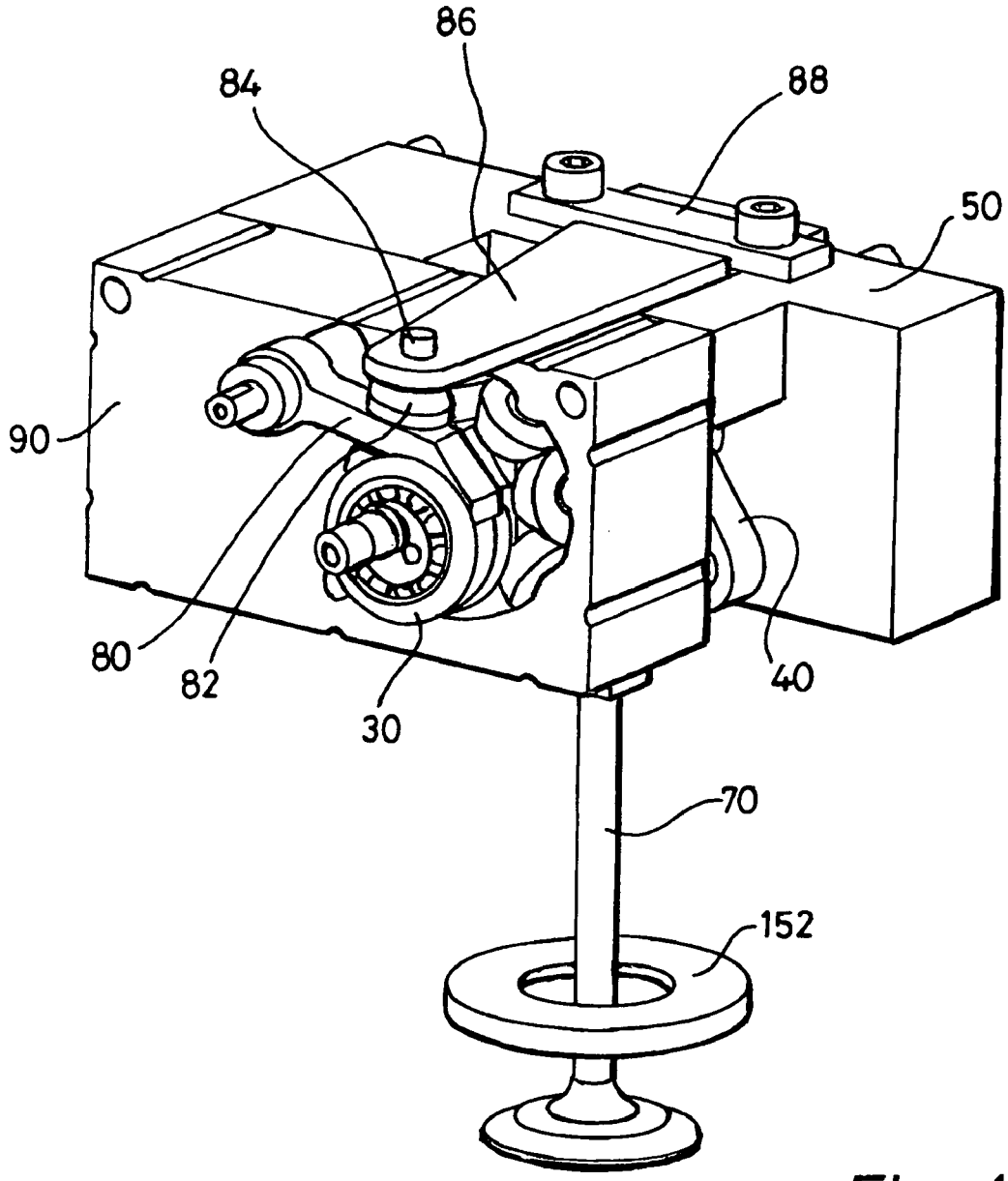
Figure 5:
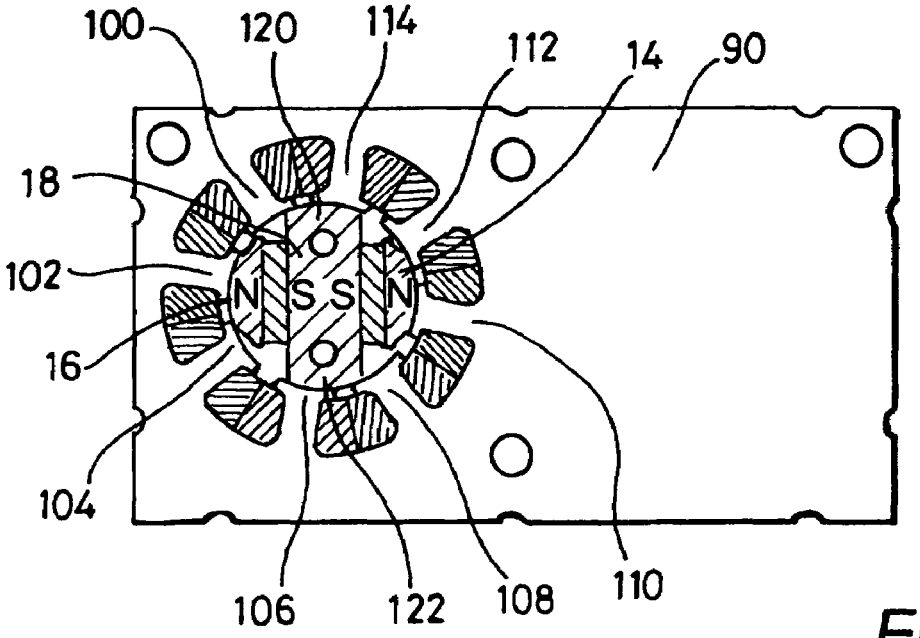
Figure 6:
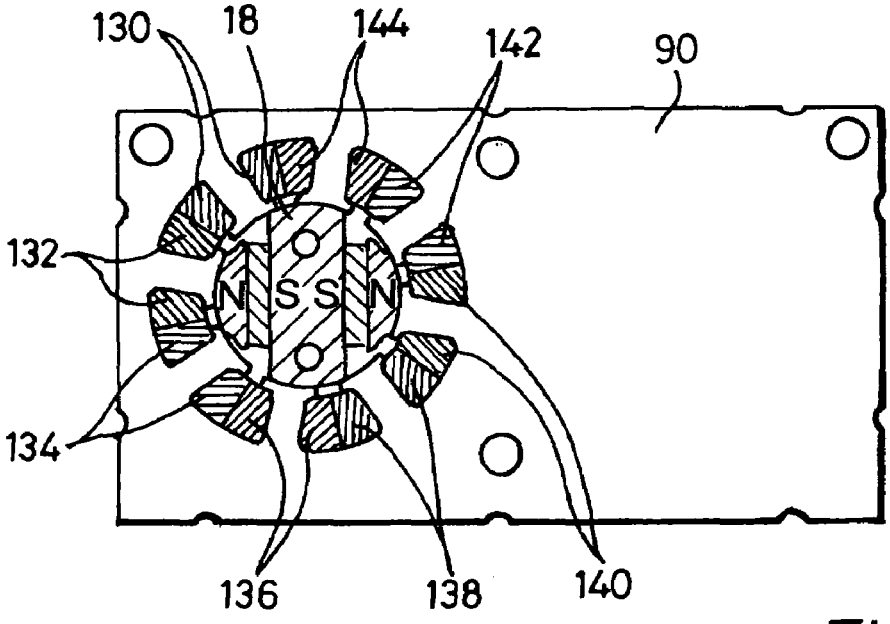
Figure 7:
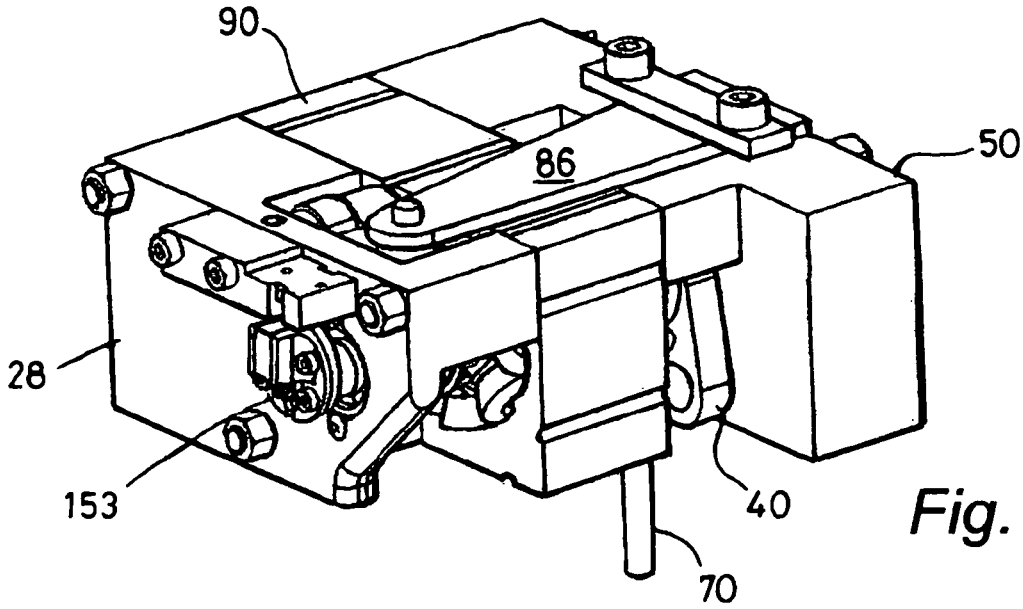
Figure 8:
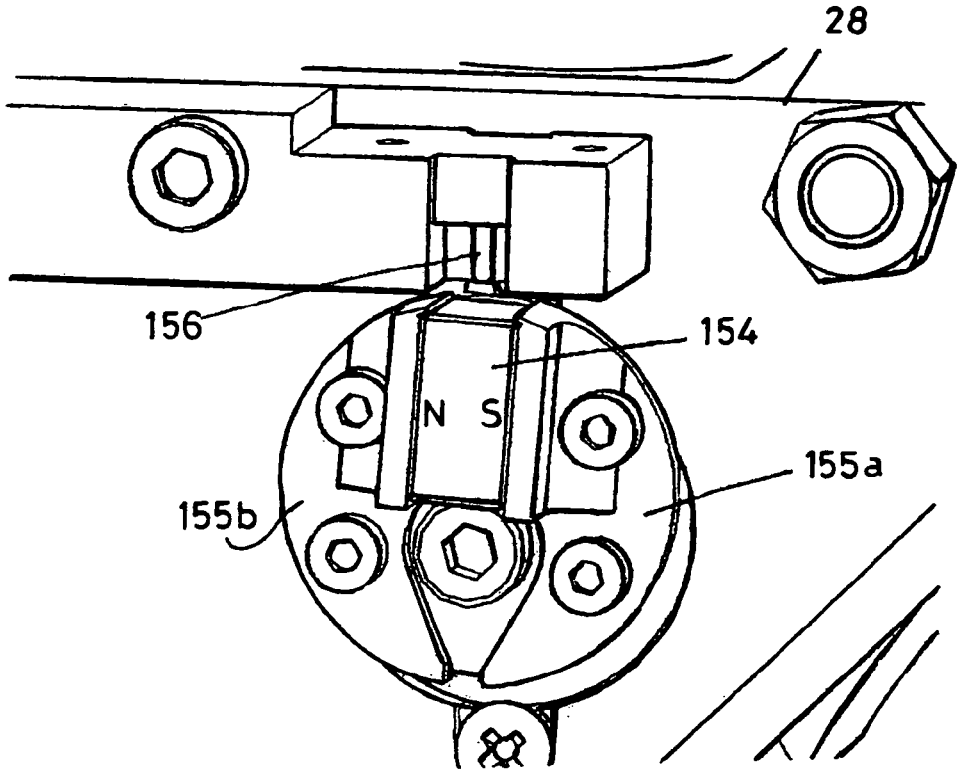
Figure 9:
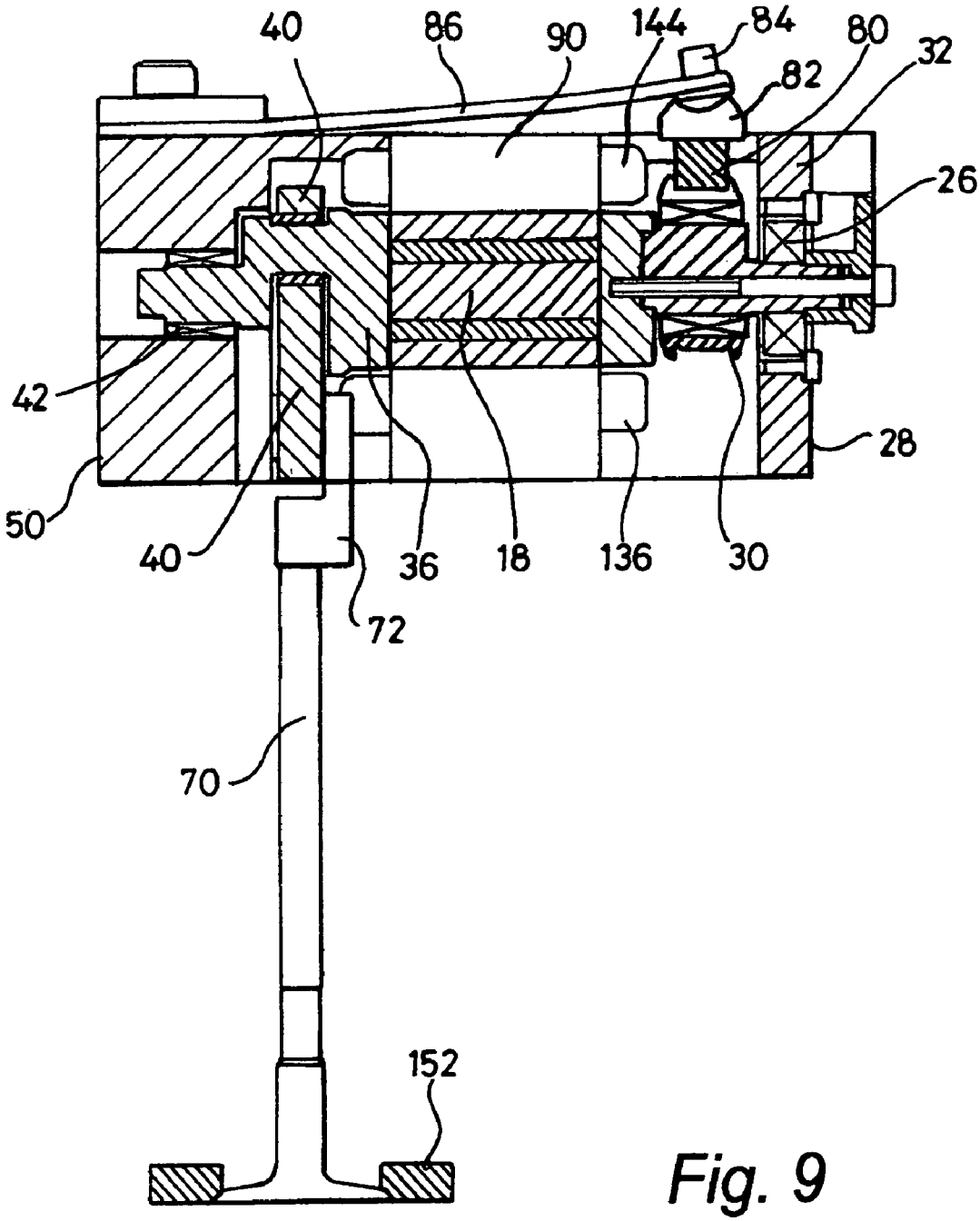
Figure 10:
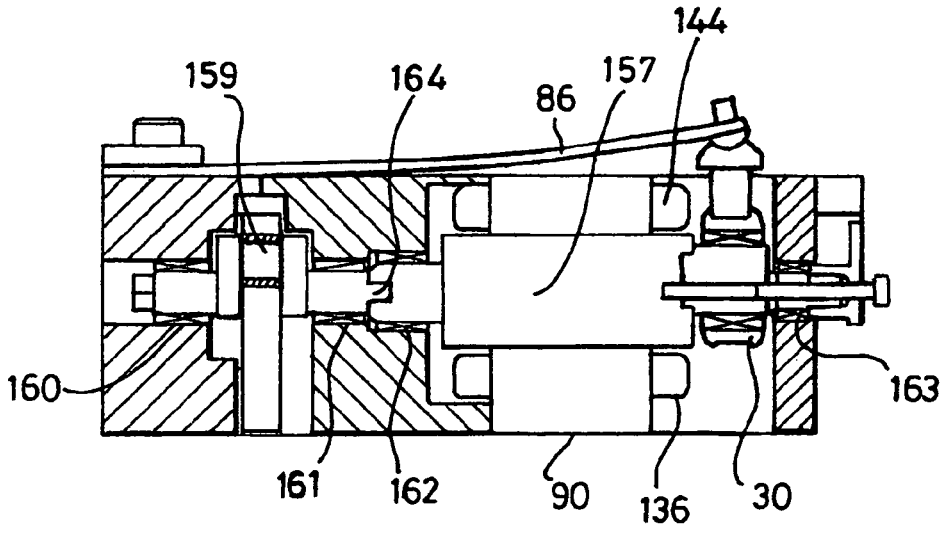
Figure 11:
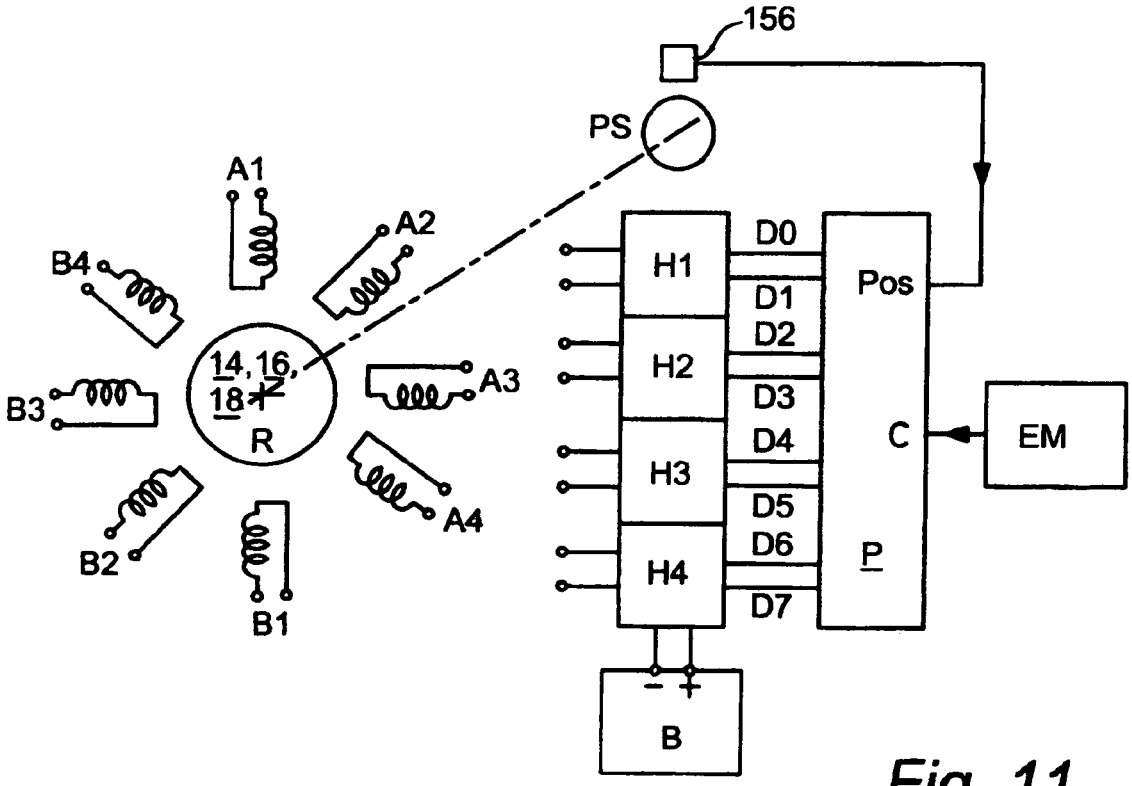
Figure 12:
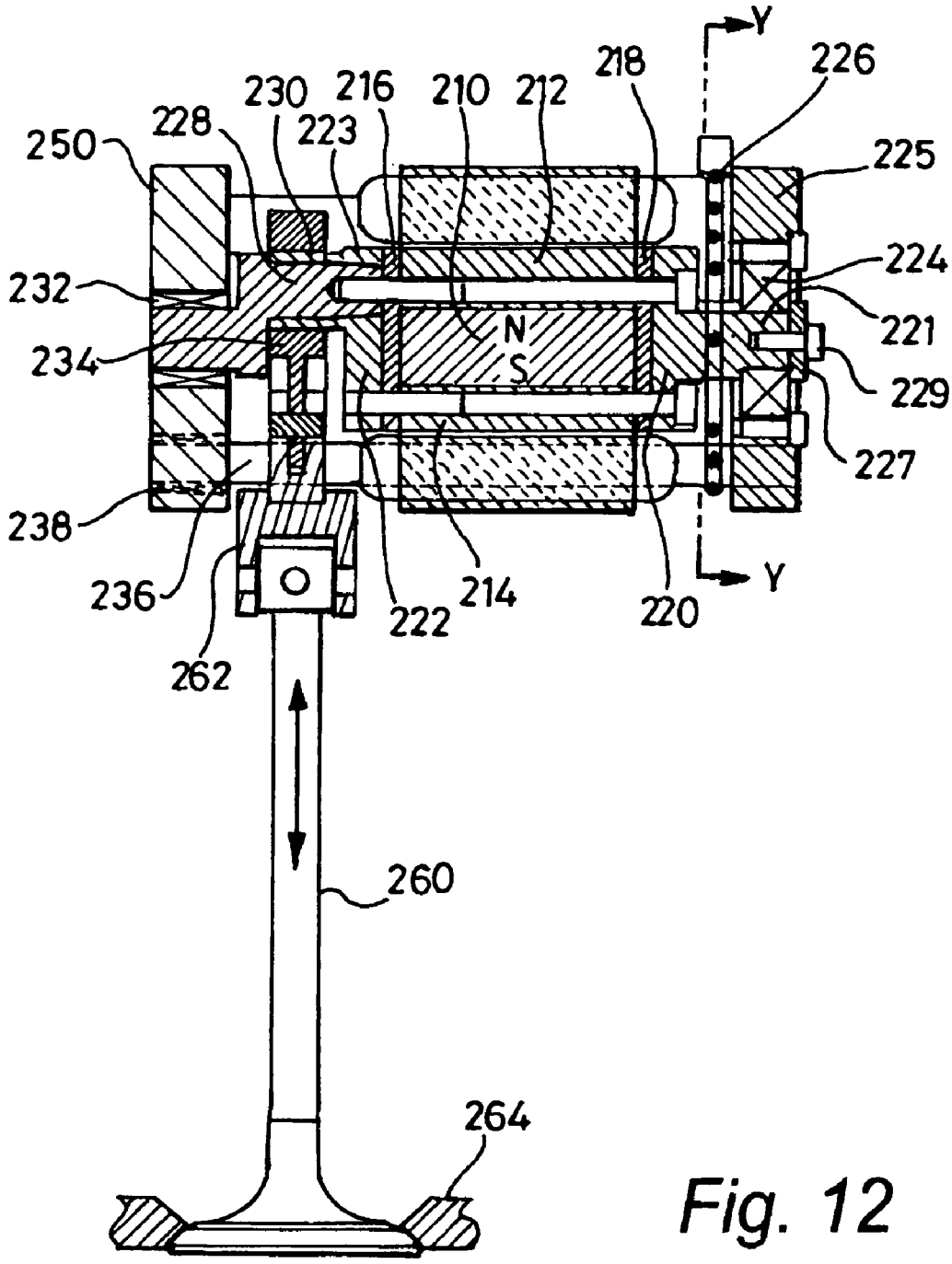
Figure 13:
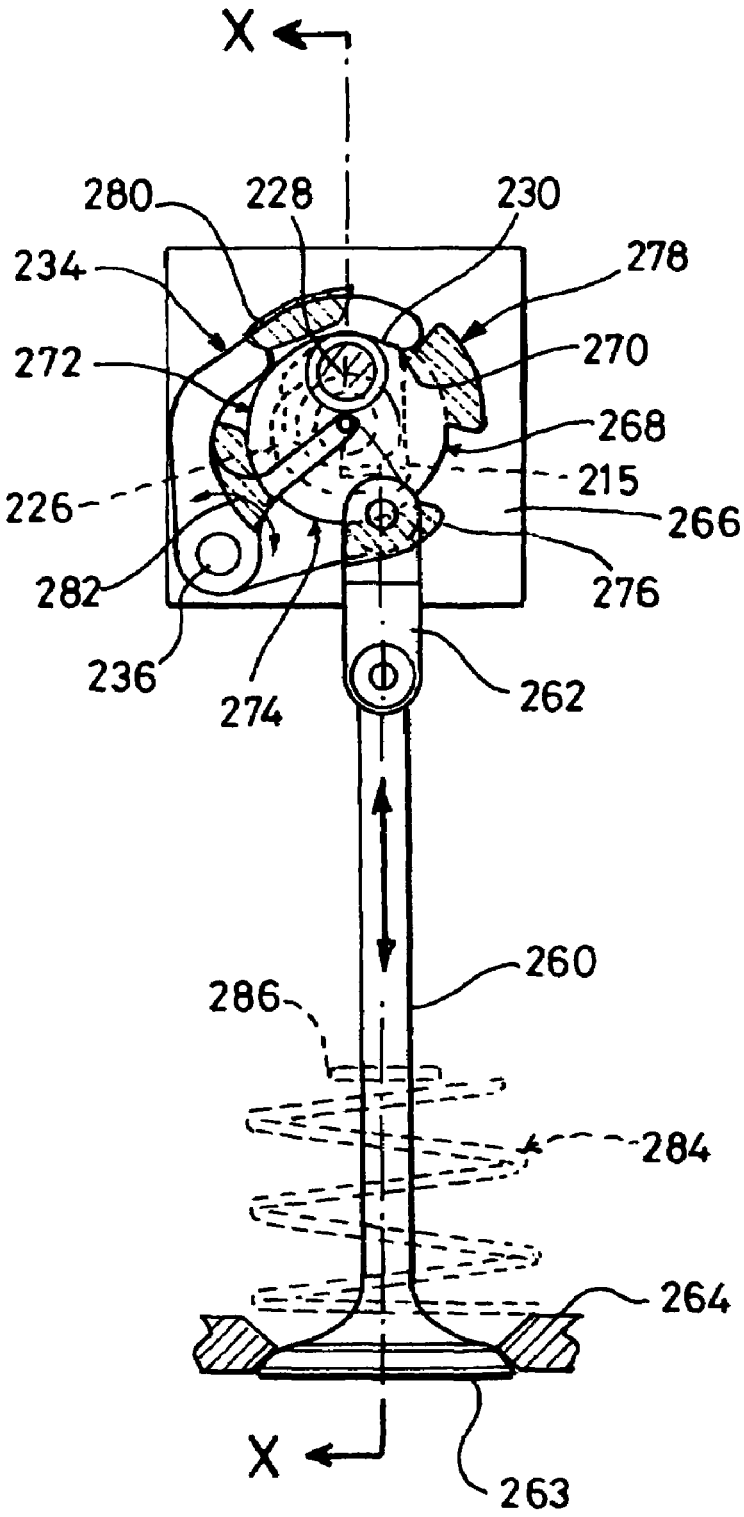
Figure 14:
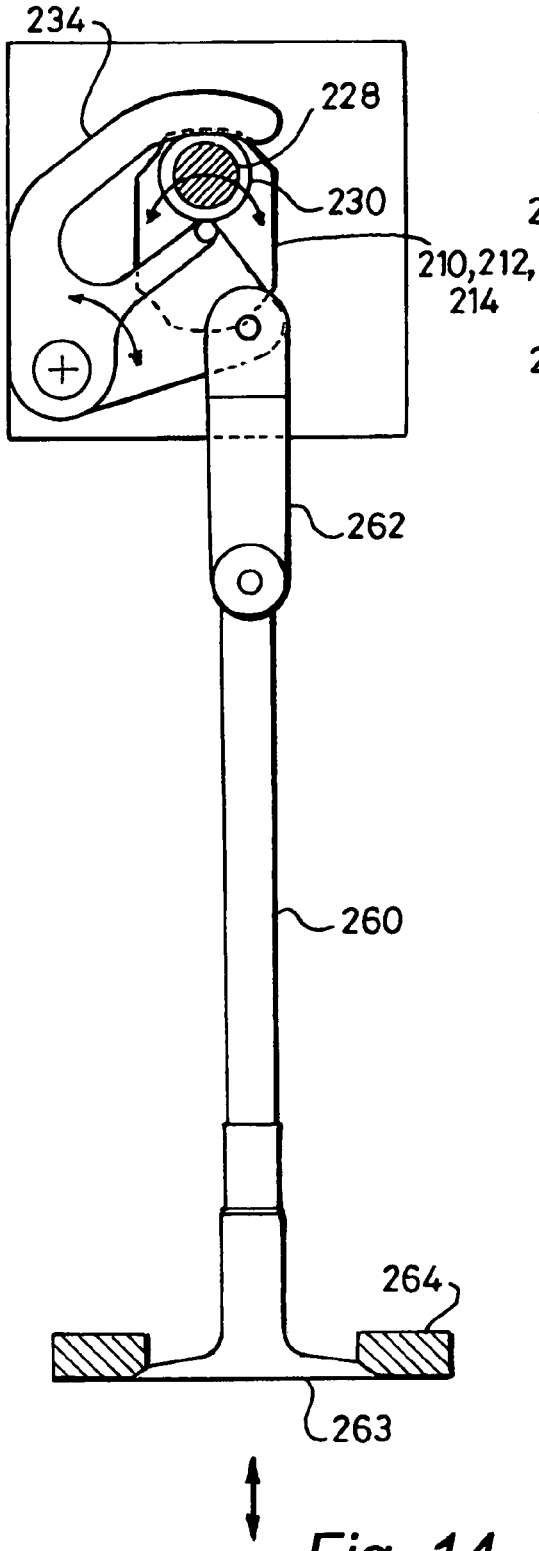
Figure 15:
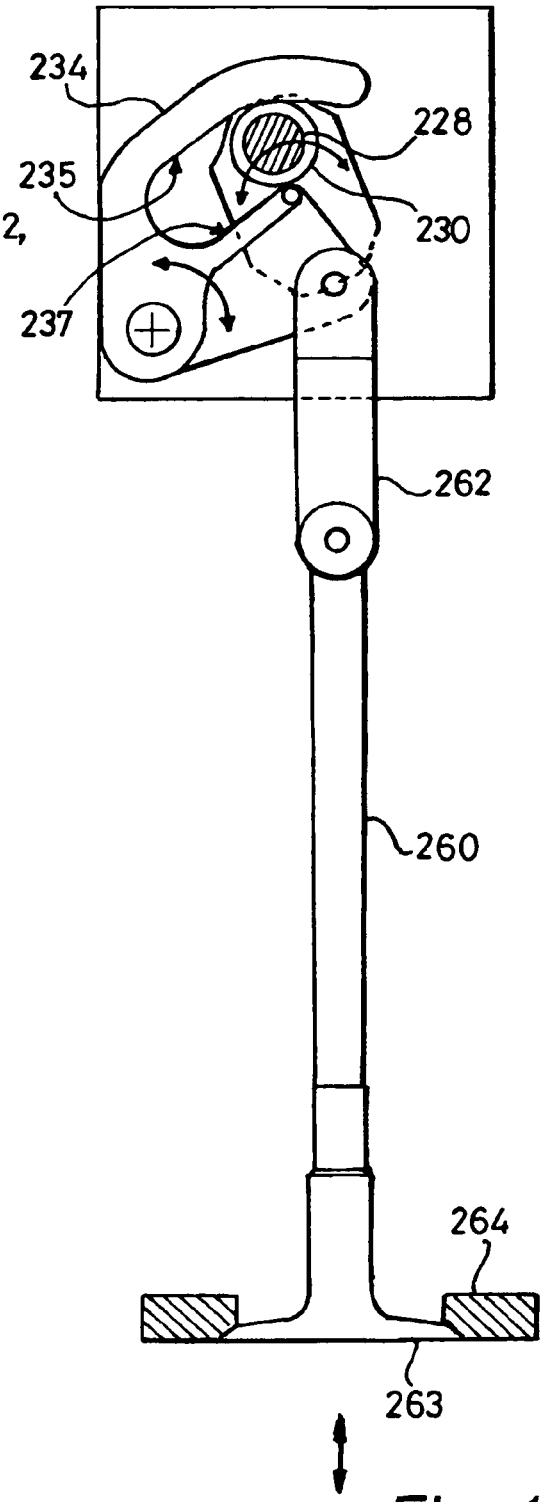
Figure 16:
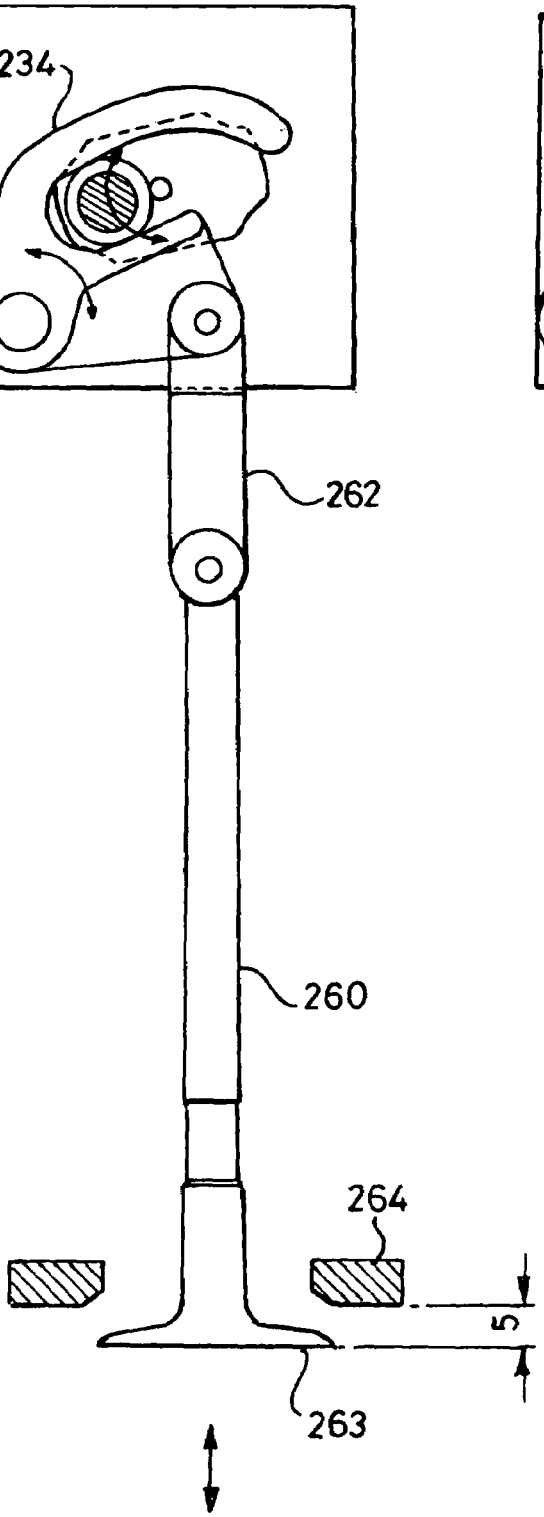
Figure 17:
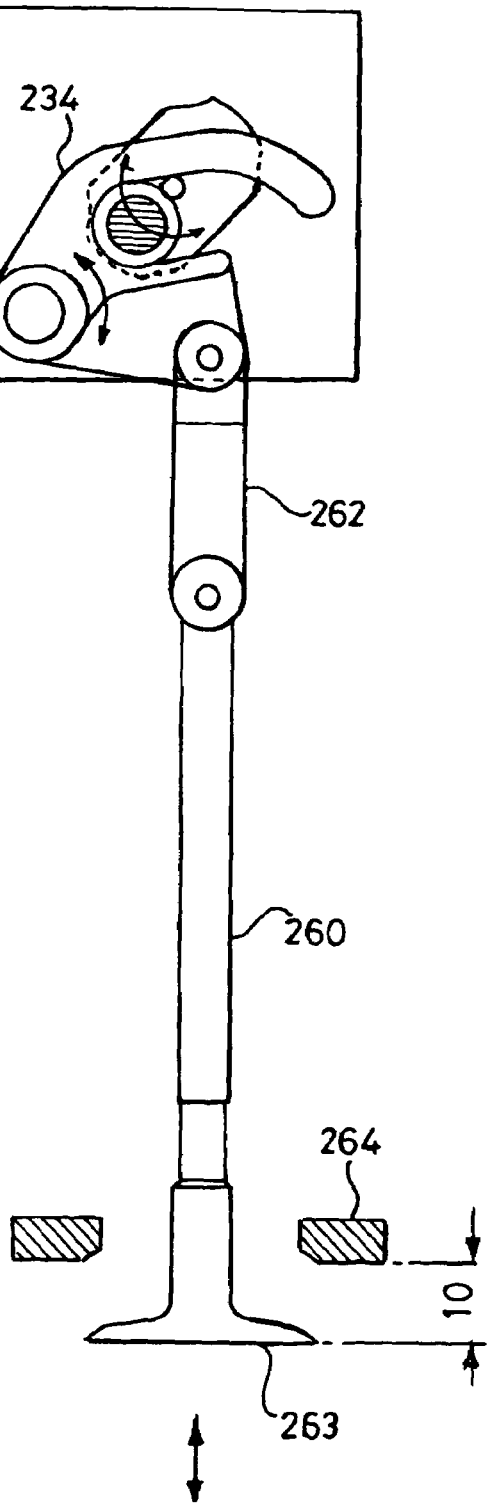
Figure 18:
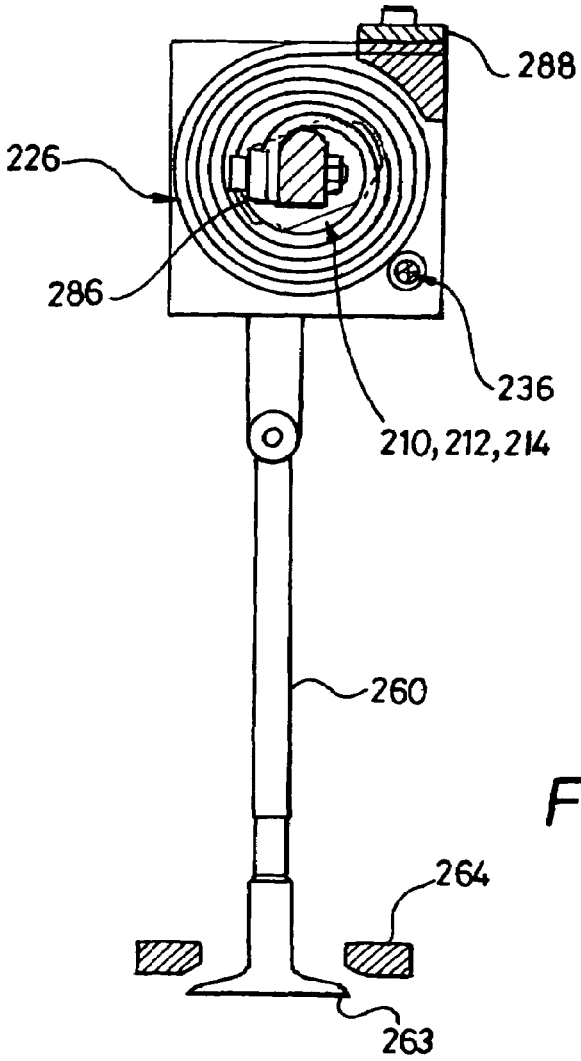
Figure 23:
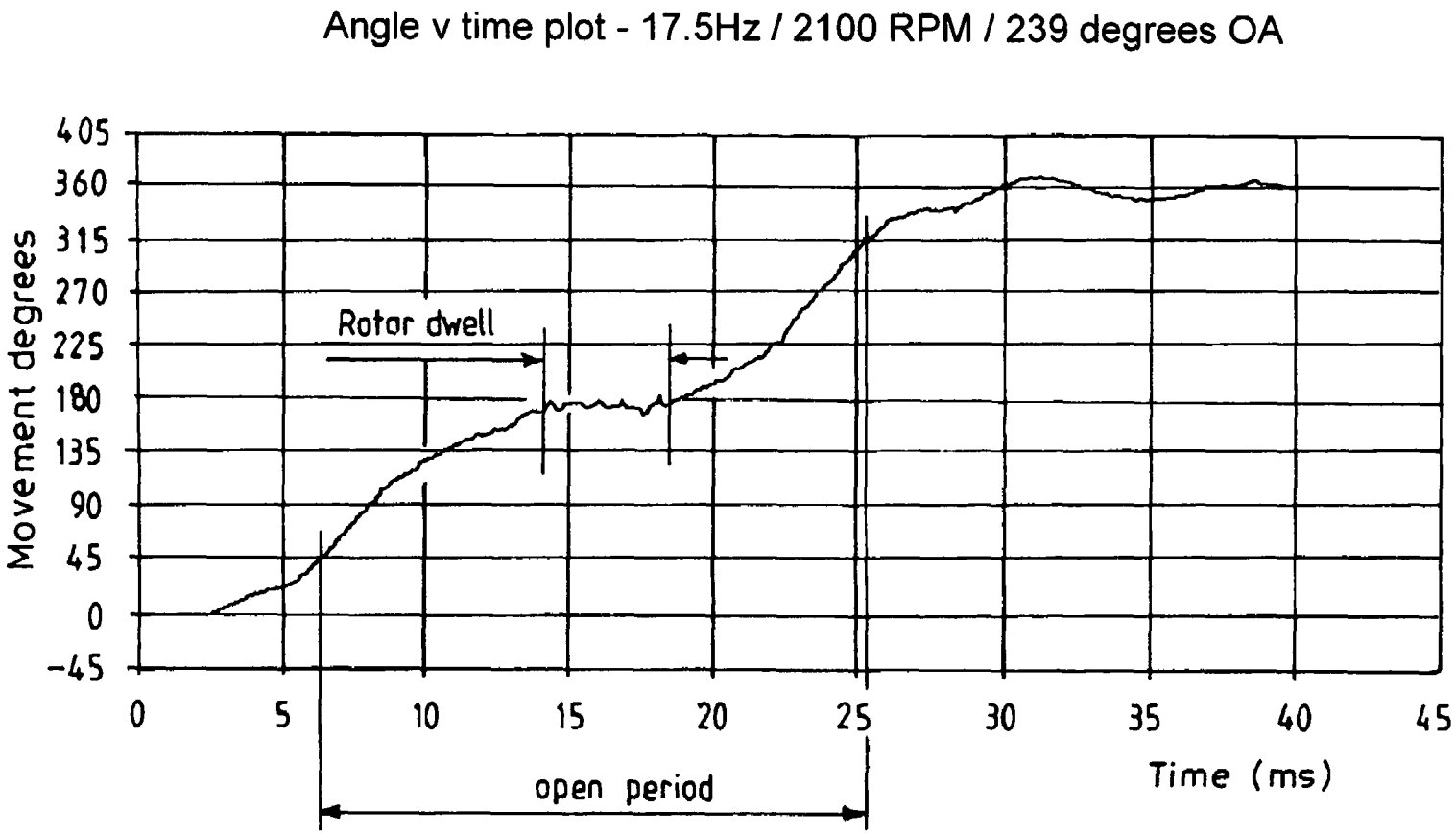
Figure 24:
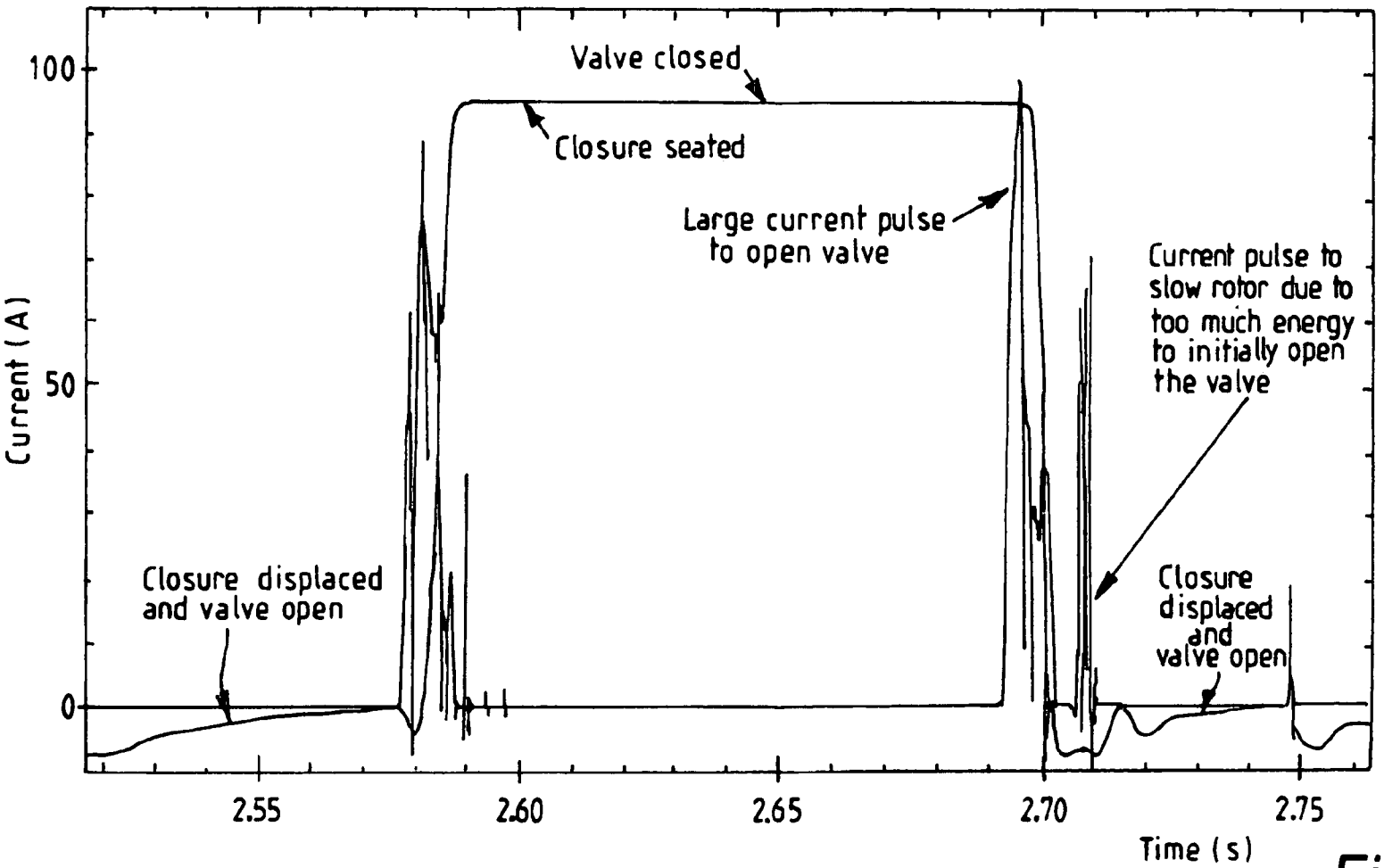
Figure 25:
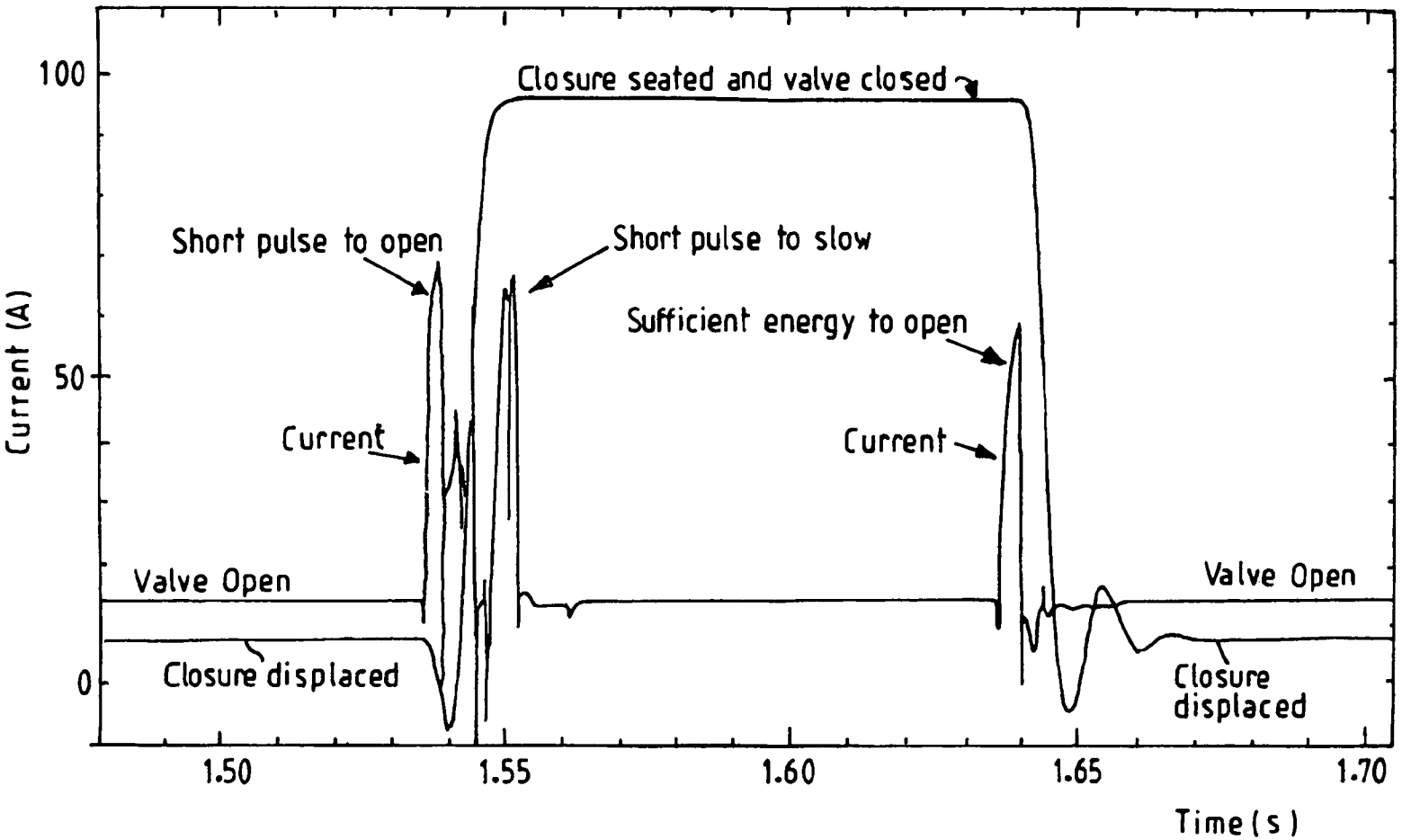
Figure 26:
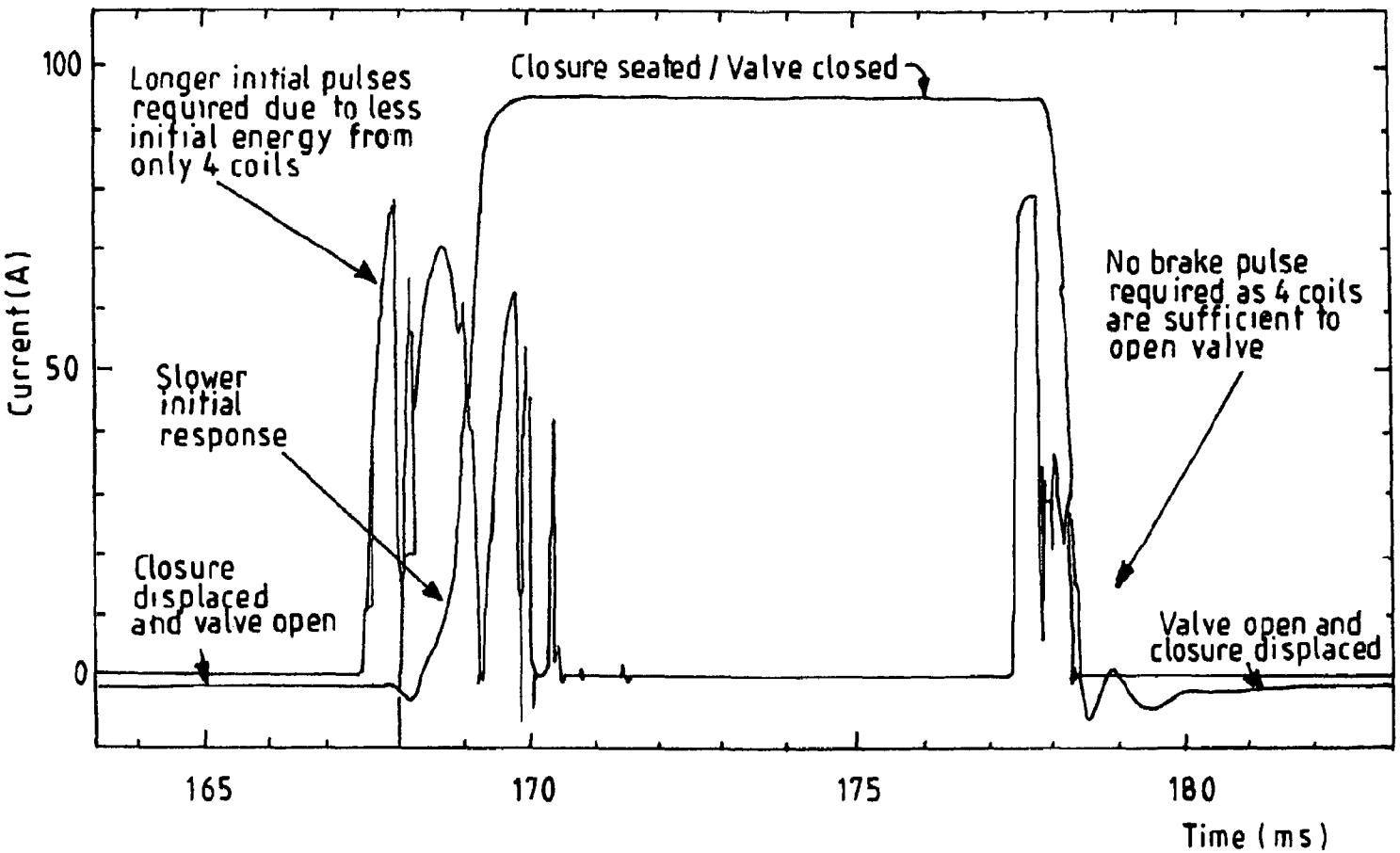
Figure 27:
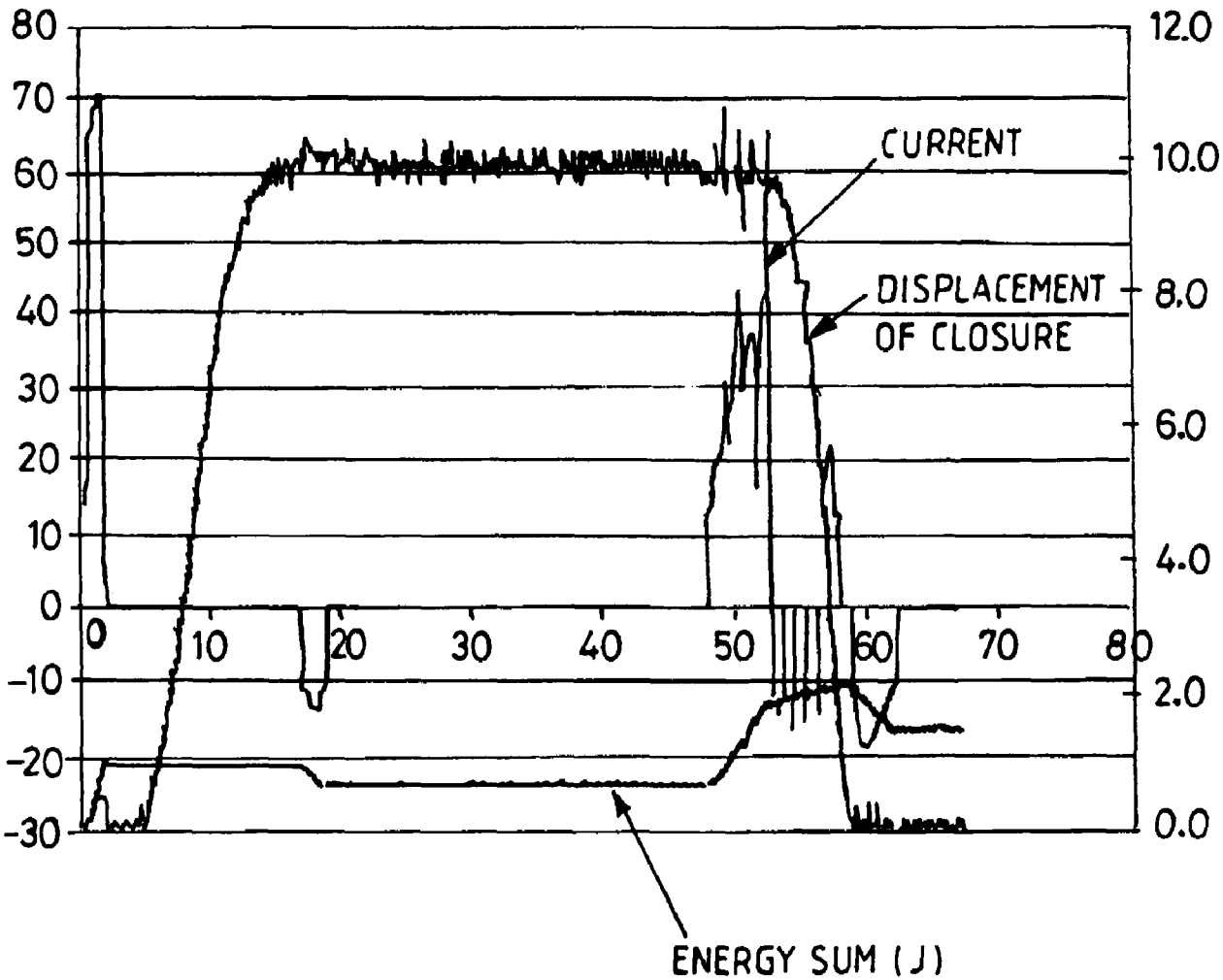
Figure 28A:
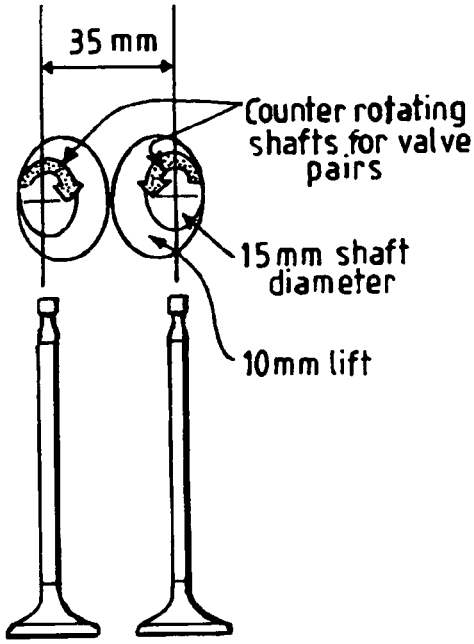
Figure 28B:
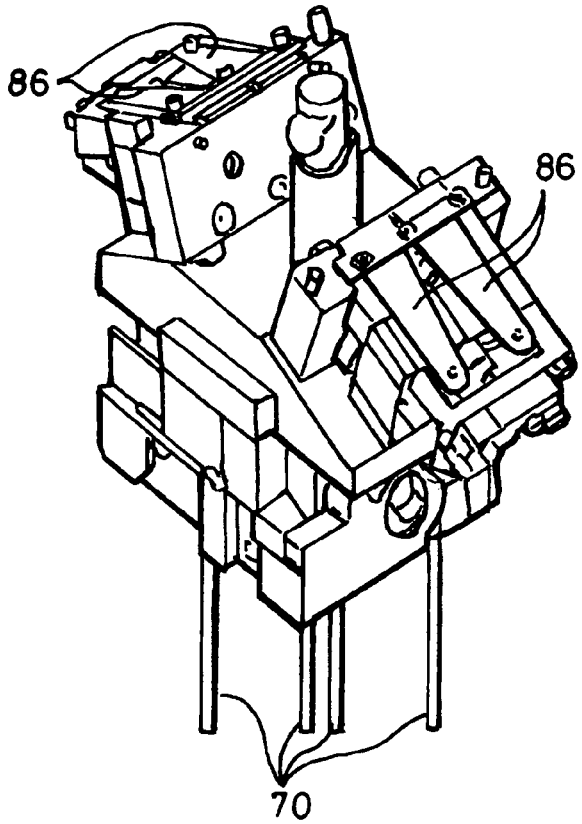
Figure 29:
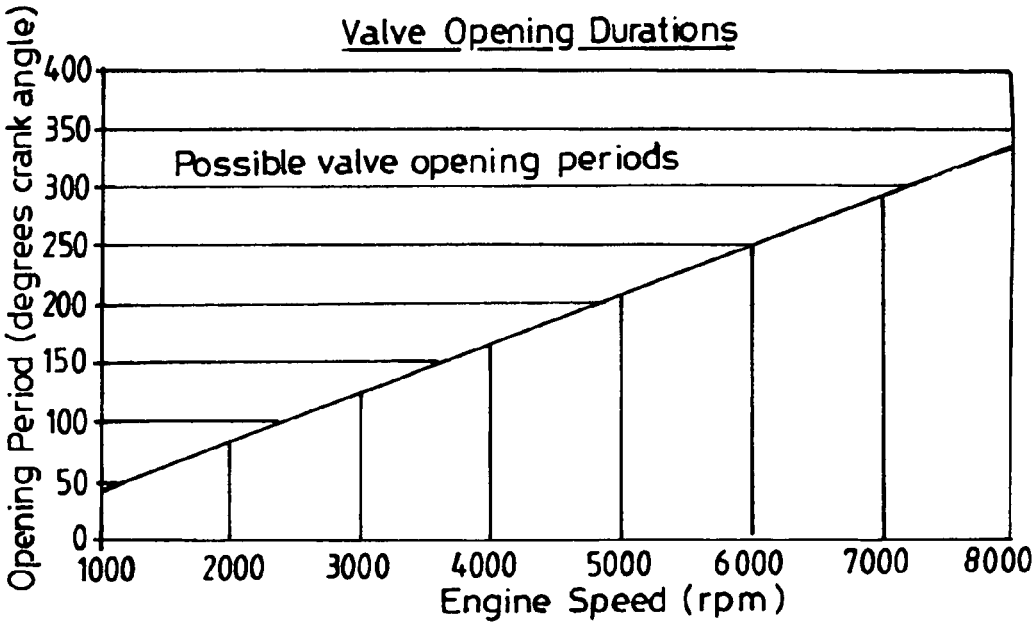

FIG. 1 is an isometric view of the rotor, viewed from the crank end,

FIG. 2 is an exploded view of the rotor and one housing, viewed from the eccentric end, FIG. 3 is an exploded view of the rotor, lever, valve and the other housing, viewed from the crank end, FIG. 4 is a view of the eccentric end of the actuator with the housing removed, revealing the second lever and the main spring, FIG. 5 is a sectional view through the rotor in a plane perpendicular to the rotor axis, showing the stator poles and rotor nodes, FIG. 6 is the same view as FIG. 5 but refers to the windings, FIG. 7 is a perspective view of the assembled actuator, FIG. 8 is an end view of the actuator to an enlarged scale, FIG. 9 is a cross section through the actuator shown connected to a poppet valve, FIG. 10 is a similar view to that of FIG. 9 in which additional bearings are in included to stiffen the rotor to allow higher speeds of rotation, FIG. 11 is a block schematic diagram showing how the current pulses are generated from various sensors and an engine management computer, FIG. 12 is a vertical section view of a bistable actuator embodying the invention coupled to a poppet valve, viewed along the axis of rotation of the rotor but including in the view a section through the poppet valve closure and the link that connects it to a lever in the actuator, FIG. 13 is a diagrammatic end view of the actuator of FIG. 12 along the rotor axis with a stator end removed, FIG. 14 is a similar view to that of FIG. 13 showing the rotor close to the one rest position, FIG. 15 is a similar view to FIG. 13 showing the rotor just leaving the one rest position, FIG. 16 shown the rotor just approaching the other rest position, FIG. 17 shows the rotor in the other rest position, FIG. 18 is another cross-section showing the spiral spring and the torsion bar spring, FIGS. 19 to 23 are diagrams of equivalent circuits of a control system according to the invention at different stages of operation, FIG. 23 shows a plot of rotor angle against time, FIGS. 24 to 26 shows plots of stator winding current against time to illustrate pulses generated during valve operation, FIG. 27 shows plots of stator winding current, valve closure displacement, and energy sum against time, FIGS. 28(*a*) and (*b*) illustrate how actuators embodying the present invention have been incorporated in an engine, and FIG. 29 shows a plot of valve opening duration against engine speed.

Referring to FIG. 1, permanent magnets 10 and 12 are sandwiched between three ferromagnetic (typically soft iron) pole pieces 14, 16 and 18 of the rotor. This magnetic assembly is located between two non-magnetic end-caps 20, 22.

Referring to FIG. 2, the end cap 22 of the rotor locates an eccentric journal 24 from which a stub axle projects through a bearing 26 located in a housing 28. Round the eccentric journal 24 runs a hollow cylindrical tyre 30 supported by a bearing 32.

Referring to FIG. 3, the end cap of the rotor 22 has a tapered hole 34 which permits the tapered end of a crank pin 36 to be rigidly secured thereto. The cylindrical region of cylindrical crank pin 36 carries a roller 38 which is received in an arcuate slot in the first lever 40. Beyond the lever 40, the crank pin 36 carries at the outboard end a crank arm having a cylindrical stub axle section which is rotatably supported in a bearing 42 which is secured to the second housing 50. The lever 40 is secured to a stub shaft 52 which rotates within two bearings 54 and 56 and is constrained axially by two thrust rings 58 and 62. The lever 40 is connected to the stem 70 of a poppet valve via a rigid link 72.

When closed the poppet valve head 150 seats against the annular seat 152 and is opened by being pushed by the actuator downwards away from the annular seat 152. Pivoting connections between the rigid link 72 and the lever 40 and the rigid link 72 and the poppet valve stem 70 accommodate any rotational relative movement of the various parts during opening and closing movements of the actuator and valve.

Referring to FIG. 4, a second lever 80 is pushed onto the cylindrical tyre 30 by a cupped sliding bearing 82 and a spherical head pin 84. The pin 84 is located in the main spring 86 which is clamped to the housing 50 by a clamp beam 88.

Referring to FIG. 5, the rotor is rotatably located within a stator generally designated 90. The stator has eight poles 100, 102, 104, 106, 108, 110, 112, 114 which surround the rotor pole pieces 14, 16 and 18. The central rotor pole piece has two magnetic nodes 120 and 122.

Referring to FIG. 6, round each pole in the stator is a winding 130, 132, 134, 136, 138, 140, 142, 144 through which electrical current can flow to magnetise the poles facing the rotor alternately as north and south poles.

The housings 28, 50 are fixed to the engine via fixings that can allow for some lost motion to prevent any large forces developing when the valve is closed. This motion is taken up during the initial rotation of the lever 40.

When considering the requirements for an actuator for opening and closing an internal combustion engine valve, the following can be considered to be fundamental requirements, namely:— long stroke
fast action
slow landing speed
large valve opening against substantial pressure
Desirable features in addition are:—
individual fully independent driving mechanism
programmable timing in both directions (variable angular ratio)
variable stroke Hitherto such valves have been opened using a camshaft, and springs have been employed to close the valves. Such mechanisms suffer from the following limitations:— fixed angular ratio
fixed stroke

By employing an actuator constructed and operated in accordance with the invention, which includes energy storage in one or more springs within the actuator drive, thereby employing so-called energy recycling, the following advantages are obtained namely:— a valve driven actively in both directions (desmodromic valve system, no conventional strong valve closing spring is needed)
full flexibility in timing (both directions)
some flexibility in stroke including a valve kept closed throughout some engine cycles
fast air inflow even at slow engine speed to achieve combustion products undesirable emission substantial reduction
individual valve driving mechanisms (each valve has a fully independent driver so that if desired not all valves have to be opened during each engine cycle)
full flexibility of engine management allowing some and not all valves to be activated in all cylinders or some cylinders
selectable engine operational modes: four stroke or two stroke allowing to maximise output power while low emission is maintained
the above mentioned mode selection may apply to some or all cylinders and, in fact, a gradual transition process can be envisaged The actuator essentially comprises a form of electric motor and can be likened to a so-called stepper motor equipped with a rotor polarised magnetically with a permanent magnet or magnets, and a multi pole circular stator. Typically the stator has at least twice as many poles as the rotor. In the bistable actuator to be described the rotor has two poles and the stator has four poles, while in the actuator which can rotate through 360° there are four poles on the rotor and eight poles on the stator. The pair of stator poles are magnetically energised by individual coils allowing full flexibility in energy management. Electric current can be delivered to the coils to drive the motor in either direction. Energy can be taken away in any position of the rotor in view of the back e.m.f. effect. To simplify the driving procedure, the coils are linked in pairs. One or more springs provide the energy recycling/storage.

In the bistable device, rotor movement is restricted to less than 180° and the rotor describes a so-called swing action. As will be described later, this arrangement has two springs acting as energy storage mechanisms and the two pole rotor has enough locking force to remain in two stable positions: one where valve is closed and the other where the valve is opened, and in this device external energy is required to change from one stable position to the other.

In the embodiment shown in FIGS. 1 to 10 movement of the rotor is not restricted and the spring mechanism allows and full 360° rotation. This is of advantage at high engine speeds since it is not necessary to stop the rotor and reverse its direction of movement at the time for which the poppet valve is open. The duration of the valve-open condition can be controlled by slowing down or speeding up the rotor during the relevant part of its rotation. This results in substantial benefit in speed and energy conservation.

During medium and slow engine speeds both types of movement (full rotation as well as swing) can be used in the case of the actuator shown in FIGS. 1 to 10, which provides an additional degree of freedom in engine management. In this configuration energy recycling is achieved using a powerful flat spring (86 in FIG. 4). The spring acts on an eccentric wheel which is attached to and rotates with the rotor and this spring does not impede full rotation of the rotor. Maximum deflection of the spring occurs at the "stationary" top position of the rotor. In this way kinetic energy is converted into potential energy and stored in the spring as the rotor comes to its top position from either direction. Therefore this configuration is equally effective in full rotation mode as well as in swing mode.

In order to deliver a pushing force strong enough to open an exhaust valve against the substantial cylinder pressure which exists at the end of a firing stroke, as well as to secure a gentle landing speed when its poppet valve a variable mechanical advantage drive transmitting mechanism is used. There are three phases during an opening cycle and three phases during a closing cycle.

The opening cycle phases are:

1. Initial rotor acceleration and energy accumulation phase—in which no linear movement occurs and there is no thrust. This is achieved using a caming surface which has little or no change in radius of curvature associated with this part of the rotor.
2. Initial opening phase—gentle linear movement, accompanied by a strong pushing force This is achieved using a modest change of curvature. In the FIGS. 1 to 10 actuator, this action is supported by the flat spring.
3. Fast opening to fully open phase—linked to rapid linear movement requiring only a modest pushing force and achieved by much more rapid change of curvature of the caming surface.

The closing cycle phases are:

1. Fast main closing phase linked to rapid linear movement and a modest pulling force on the valve closure, achieved by very sharp change in caming curvature. During this phase kinetic energy recycling starts.
2. Gentle landing, final closing phase, linked to deceleration of the rotor producing gentle linear movement achieved by more modest changes in caming surface curvature and the rotor now beginning to push against the flat spring.
3. Final slowing down of the rotor to its final rest position during which there is again no vertical movement, and no pulling force, on the valve closure. This is achieved by the constant radius caming surface and this phase allows a bounce-free valve closing sequence to be achieved. During the rotor stopping process some degree of instability can occur, but since no linear movement is transmitted during this phase any such instability is not transmitted to the valve closure.

It is important to know the instantaneous angular position of the rotor and to this end an accurate position sensor is provided. This position sensor is shown at 153 attached to a rotating part of the actuator in FIG. 7 and FIG. 8. The sensor can generate a digital or analogue format signal. An analogue technique is shown where a permanent magnet 154 is attached to two halves of an eccentric disc 155*a*, 155*b* secured to the rotor shaft, in close proximity to a Hall effect sensor 156. Such a sensor provides an absolute and accurate reading of angular position of the rotor.

Driving Strategy

The actuator shown in FIGS. 1 to 10 can be thought of as comprising a permanent magnet based stepper motor equipped with an accurate angular position sensor and in combination with an engine management system as shown in FIG. 11 can be used to implement a variety of valve opening and closing strategies. These will be described by means of examples as follows:

1. Half Cycle Movement triggered by opening clock pulse, the rotor starts moving, the sensor provides continuous information about the current rotor position to secure most effective coil driving currents sequence and therefore constitute an electronic commutator, and initial movement is assisted supported by energy stored in the spring. The combined effort of electromagnetic torque and spring force is able to open a poppet valve against a substantial internal cylinder pressure.

as the rotor approaches the 180° position at which the valve is fully opened, the driving electric current is withdrawn and an electric braking procedure is instigated by either shorting the coils or reversing the current flow, so that the electric motor is momentarily converted into an electric generator.

The movement is completed by reversing the rotation of the rotor so that it reverts to its start position.

2. Part Cycle Movement

Here the rotor is stopped before it reaches the 180° position and then reversed, the speed of the rotor being adjusted to occupy the required overall interval of time for operating the valve.

3. Full Cycle Movement with Additional Stop

Here the rotor completes the full 360° but pauses or slows down at and near the 180° point if it is necessary to keep the valve open for longer than would be the case if the rotor continued to rotate at a constant speed.

4. Full Cycle Movement without Additional Stop

Here the full 360° rotation is performed without any pause.

Constructional Variations

The basic configuration is shown in FIG. 9 where the entire rotating assembly of rotor 157, crank 158, eccentric wheel 32 position sensor disc and magnet 153 are supported by only two bearings 26 and 42. The rotating assembly is under substantial stress caused by centrifugal forces generated during rotation of the eccentric wheel the varying spring force acting on the wheel and when opening a valve against cylinder pressure. For these reasons the rotating assembly must be as stiff as possible to resist these forces. Increasing the diameter to increase stiffness is not convenient since this results in lower angular acceleration. To reduce angular inertia the rotor should be small in diameter. To meet both conditions (low inertia and mechanical strength), four bearings are proposed as shown at 160, 161, 162, 163 in FIG. 10.

The rotor and valve driving extension are shown in FIG. 10 as being two separate parts, and rotational drive is transmitted via coupling 164.

The actuator of the invention allows a desmodromic valve operating system to be employed in an internal combustion engine.

In such a system the valve is actively driven in both directions (to open and to close) achieving minimum time for opening and closing without putting undesirably high stress on a conventional valve closing spring. In fact there is no need to have a strong valve closing spring at all and it can be replaced by very modest spring which provides just enough force to keep the already closed poppet valve in it stable closed position. In this way any potential bouncing effect is greatly reduced. This "modest" spring is only shown in one of the figures in the drawings (FIG. 13).

In FIG. 11 the following items are shown.

R is a Rotor mechanically coupled with Position Sensor PS

P is a Microprocessor

PS is a position sensor which provides Position Data—it could be in analogue or digital format EM is an engine management computer-based unit.

C shows the supply of Control Data from the Engine Management Unit

D0-D7 is the digital link between microprocessor and drivers

HI-H4 are H Bridge type bidirectional drivers

A1 and B1 is a one pair of stator coils

A2 and B2 is second pair of stator coils

A3 and B3 is a third pair of stator coils, and

A4 and B4 is a fourth pair of stator coils.

PS provides the Microprocessor P with information representing the Current Position of the rotor R. It could be a digital formal or in analogue format. The link is always to provide a constant absolute and accurate position of the rotor.

The action to open or to close a valve starts on commands received from the Engine Management Unit EM.

The Microprocessor converts this to a target and compares it with the Current Position. On that basis a specific driving strategy is selected and executed by putting appropriate Driving Data to Bi directional Bridge Drivers H1-H4. The Drivers are very low resistance switching units and they provide time direct connection between coils and a source of electric current represented by a Battery—B.

One driver typically serves one pair of coils (connected in parallel or series).

There are four modes of operation; Fast Forward, Fast Backwards, Brake, Run Free.

The Microprocessor constantly monitors the Current Position versus Target, and develops an appropriate driving strategy. In this way an intelligent brush-less commutation process is implemented and the actuator drive can be thought of as comprising an intelligent brush-less electric motor.

It should also be noted that the actuator is subject to a constantly changing load caused by rotor inertia, spring force, pressure force, valve inertia and a wide range of temperature. It is also under a rapidly changing target. Thus with changing engine speed and/or load etc., the valve may need to be partially opened or fully opened or closed. Therefore very frequent start-stop commands are in use. This is why it is necessary to employ a Microprocessor as an intelligent programmable decision making device.

FIGS. 12-17 of the drawings show a swing mode valve actuator.

In these figures, a permanent magnet 210 is sandwiched between two ferromagnetic (typically soft iron) pole pieces 212, 214. The magnet and poles are located between two end caps 220, 222 with non-magnetic shims 216, 218 sandwiched between the magnetic elements and the end caps. Together the magnet pole pieces and end caps form a rotor. End-cap 220 includes a stub axle 221 which is received in a rolling bearing 224 fitted in a housing end 225 and retained by a washer 227 and bolt 229.

A spiral spring 226 is attached at one end to the stub axle 221 and at its other end to the housing end 225.

End-cap 222 has a tapered hole 223 which permits the tapering end of a pin 228 to be rigidly secured thereto.

The cylindrical region of the pin 228 carries a roller 230 which is received in an arcuate slot or groove in a lever 234. Beyond the lever, the pin 228 is carried at the outboard end of a crank arm having a cylindrical axle section which is rotatably supported in a needle roller bearing 232 which is secured in the second housing end 250.

The lever 234 is secured to a torsion bar spring 236 and is otherwise engaged by the roller 230. The spring 236 is rotatably located at one end in a bush 238 in stator end 250 and rigidly held at its opposite end in stator end 248. Rotation of the lever 234 about the axis of the torsion bar 236, stores energy in the latter as it is twisted.

As best seen in FIG. 13 the rotor is rotatably located within a stator generally designated 266 formed by the two ends 248, 250 between which extend four poles 268, 270, 272, 274 which surround the rotor poles 212, 214 albeit with a small air gap therebetween. Around each pole is a coil 276, 278, 280, 282 respectively, through which current can flow to magnetise the poles facing the rotor alternately as North and South poles.

The lever 234 is connected to the stem 260 of a poppet valve via a rigid link 262. When closed the head 263 of the valve seats against annular valve seat 264, and is opened by being pushed downwards away from the annular seat 264. Pivoting connections between the link 262 and the lever 234 and the link and stem 260 accommodate any non-linear relative movement of the various parts during opening and closing movements of the actuator and valve closure. They can also introduce a small amount of lost motion if desired which is taken up during the initial rotational movement of the lever.

FIGS. 14 to 17 are simplified views of the actuator shown in FIG. 13, and show how movement of the rotor is related to movement of the cam-lever and poppet valve. For convenience the same reference numerals have been employed throughout FIGS. 13-17. In particular the stator coils and poles are not shown in FIG. 14 et seq.

FIG. 14 essentially corresponds to FIG. 13 in that the rotor 215 is shown in its most clockwise position, with the roller 230 in its uppermost position.

In FIG. 15 the rotor is assumed to have rotated anticlockwise through a few degrees (typically 10-15°). The radius of curvature of the lever 234 engaged by the roller 230 over that rotation of the rotor, is essentially constant and is parallel to the locus of the axis of the roller 230. Therefore during that initial movement the rotational movement of the rotor is not converted into linear movement of the link 262 or stem 260 of the poppet valve 263.

This lost motion between the rotor and the link 262 permits the rotor to accelerate in an unimpeded manner during the first part of its anticlockwise rotation. Thereafter the shape of the caming surface 235 and opposed finger 237 of the lever 234 is such that with continued anticlockwise rotation of the rotor 215 the engagement of the rotor 230 with 235 and 237 causes the lever 230 to pivot about the axis defined by the torsion bar spring 236, twisting the latter in the process, and simultaneously forcing link 262 in a downward direction. This in turn forces the valve head 263 also in a downward direction away from the valve seat 264, to open the valve.

FIG. 16 shows the rotor shortly before it reaches its fully anticlockwise position (which latter is shown in FIG. 17), and in both FIGS. 16 and 17 the valve head 263 is shown displaced clear of the seat 264.

Although only shown in FIG. 13, a helical spring 284 is shown trapped between a stop 286 attached to the valve stem 260 and the seating 264. This spring is similar to each of the springs usually found at the top of a cylinder head of an internal combustion engine, each of which holds closed one of the valves.

However since the actuator of the present invention provides a positive drive for the valve in both opening and closing directions, the spring 284 could in theory be dispensed with. Nevertheless in order to ensure reliable closing of the valve head against its seat, a compression spring which requires only a modest force to compress it may be provided as shown.

Reversing the currents supplied to the stator coils will cause the rotor to rotate clockwise and lift the valve head 263 back into contact with the seat 264, thereby to close the valve, and the rotor returns to the position shown in FIG. 14.

FIG. 18 is a cross-sectional view on the line YY in FIG. 12 and shows the spiral spring 266 clamped at his inner end to the end cap 226 of the rotor 215 by clamp 286, and at its outer end to the stator housing end 225, by clamp 288. Also visible is the torsion bar 236 which provides the pivoting axis for the lever 234 and serves also as the second spring.

Figure 18A:
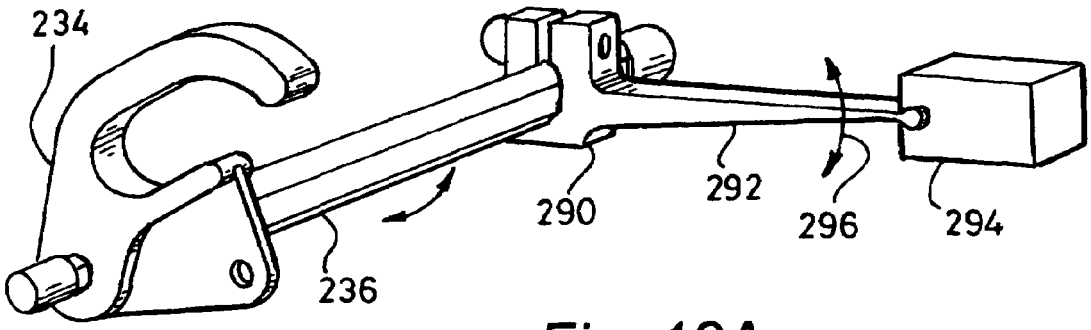
Figure 19:
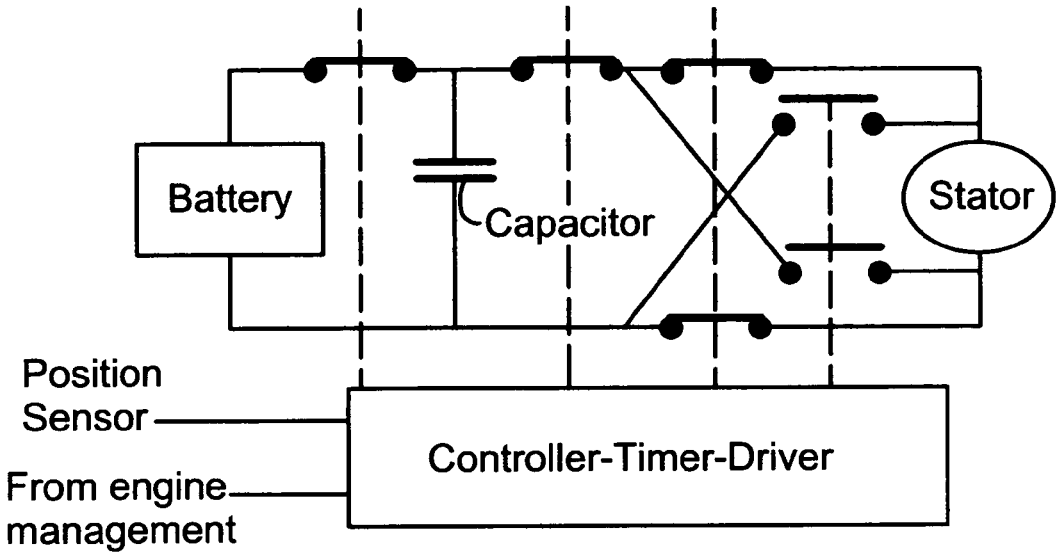
Figure 20:
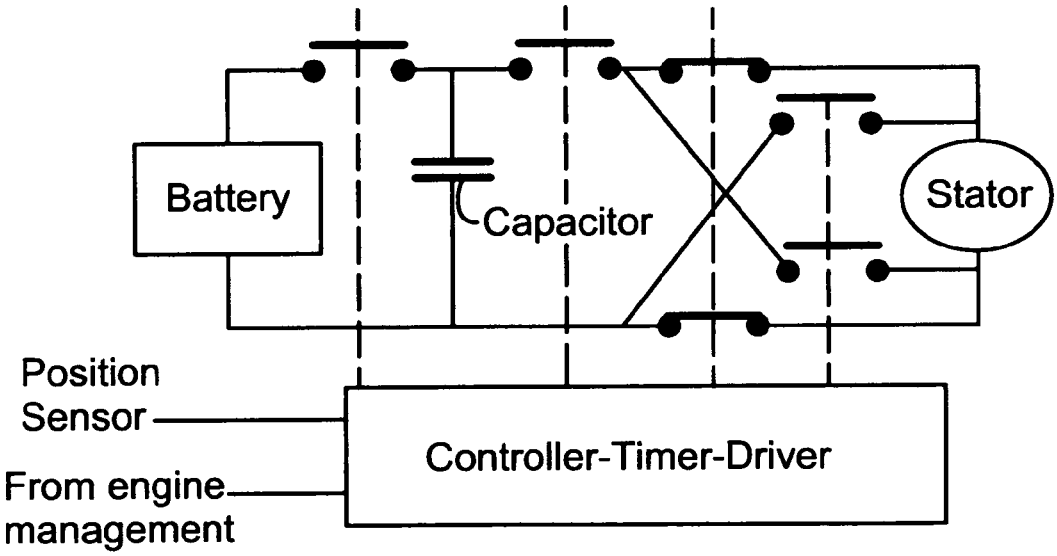
Figure 21:
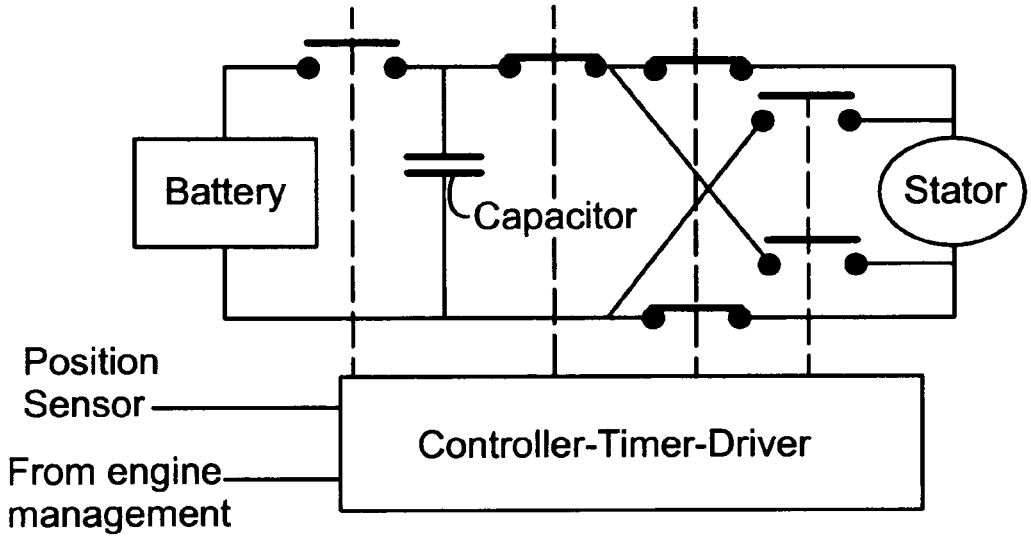
Figure 22:
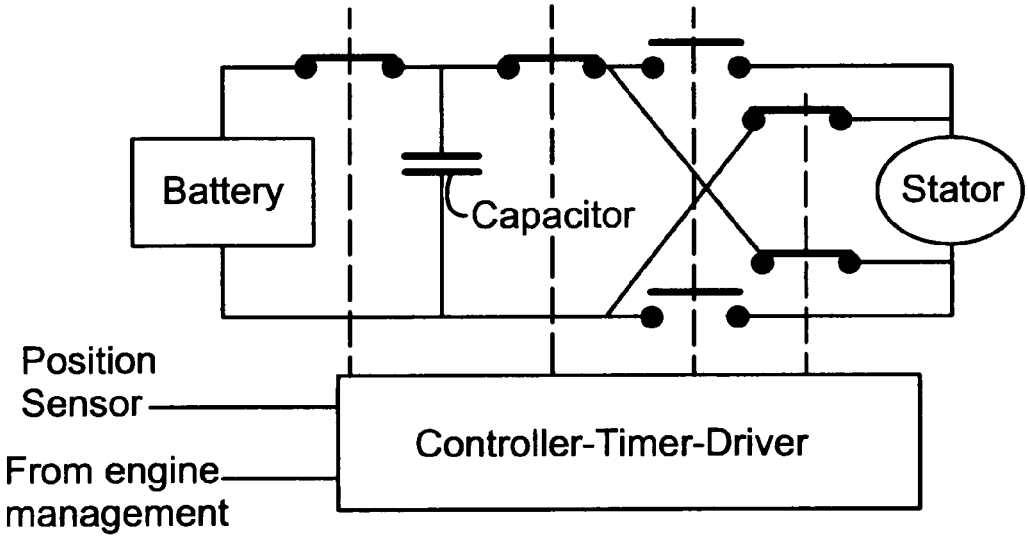

A perspective view of the lever 234 and a modified torsion bar arrangement is shown in FIG. 18A. Opposite ends of the torsion bar 236 are received in bearings at opposite ends 225, 250 of the housing at (see FIG. 12). A clamp 290 clamps a second torsion bar 292 to the first bar 236 and at its outboard end is received an anchor block 294. The lever 234 is rotated by the rotor (not shown in FIG. 18A). This rotation is transmitted to the left hand end of bar 236 by flats on the bar 236 and a correspondingly shaped opening in the lever 234.

The clamp 290 prevents the bar 236 from rotating at the point where the clamp 290 engages the bar 236, but the bar 292 is able to flex as denoted by arrow 296, its flexing 292 thereby permitting continued limited rotation of lever arm 234.

When the rotor is reversed the energy stored in 292 and 236 is available to assist in rotating lever 234.

System Description

FIGS. 19 to 23 are equivalent circuits of the control system during operation, when in the ON mode, free run (i.e. electrical current "off") mode, the Braking mode (during which electrical energy is reclaimed), and the STOP mode (used to arrest motion if overrun is detected as being likely or just to occur).

Functional design parameters set for the proposed IVA system are as follows:

1. Safe, non-destructive, failure modes
2. Capability of operating within a temperature range of −40° to +150° Celsius and with valve head temperatures of 700° Celsius
3. Capability of operating in an oil/air mixture environment
4. Capability of operating at an engine speed of up to 8000 rpm
5. Capability of providing 10 mm of intake or exhaust valve lift (with a valve mass of 36 g)
6. Capability of operating a 29 mm diameter poppet valve against a cylinder pressure of 6 bar
7. Capability of providing a maximum seat impact velocity of 240 nm/sec (equivalent to 0.01 mm/cam deg of conventional valve train)
8. Capability to shape valve opening and closing events to avoid piston clash
9. Free position of valve to be closed (valve seated)
10. Provision of variable valve lift from 0-10 mm
11. Electrical power consumption to be similar to current mechanical valvetrain systems (allowing a 12 volt electrical system)

The actuator tested and referred to below has a four-pole rotor constructed from permanent magnets and a stator with eight coil windings arranged as four opposed pairs.

The actuator system referred to below utilises a leaf spring which is loaded and unloaded via an eccentric of the rotor shaft. Other alternative energy recovery devices which can be used include torsion bars and torsion springs. The energy stored in the spring mechanism is used to assist in the opening of the poppet valve. The loading of the spring mechanism in the latter stages of the valve event assists in reducing valve seating velocity. Both these actions reduce the energy requirement from the electrical system for the next event and hence improve system operating efficiency.

Each actuator has its own positional sensor in the form of a reluctor ring on the rotor read by a Hall effect-sensor, which is used by the control system.

System Dynamics

A complete valve event can be as a result of an actuator displacement of up to 360 degrees. As depicted in the drawings one full rotation of 360° results in a valve opening and closing sequence giving a maximum valve lift of 10 mm.

In the case of an oscillatory motion of the rotor achieved by rotating the actuator through less than 180° and then back again, the poppet valve will only be partially opened so that a lift of less than 10 mm is achieved. The reverse rotor motion closes the valve.

The rotor and mechanism thus allows fully variable poppet valve lift and duration operation, creating the potential for the development of throttleless gasoline engines.

The actuator embodiment referred to below has a maximum speed of response of 7 ms for a complete valve event. At 700 rpm, 7 ms equates to a valve open period of 296 degrees crank angle, whereas at 1000 rpm, 7 ms equates to a valve open period of just 42 degrees crank angle. Therefore where lower valve lift is required the actuator is oscillated between the home position and less than 180°, or held at a low valve lift position.

FIG. 24 shows angle versus time.

Energy is only required to change the position of the poppet valve between poles of the actuator. If no software control is provided and a large current pulse is delivered to move the rotors an overshoot can occur.

A first method of counteracting this is to redefine the position of the current pulse until the required position is achieved.

FIG. 25 shows how an iterative process achieves this.

In accordance with a preferred feature of the invention, software is adjusted to generate correcting current pulses to slow the rotor, which enables extremely low valve seating velocity to be achieved if for example satisfactory control from the mechanical mechanism cannot be achieved.

In this preferred arrangement, PWM control delivers short current pulses and utilises continual position sensing as shown in FIG. 26. This also minimises the energy required.

As shown in FIG. 26, a short current pulse maintains speed of response to open, and can be followed by one or more short pulses to slow down the rotor movement if required.

It is possible to drive the valve open within 3.5 ms but this is not required under all operating conditions, and in the interests of energy management it maybe favourable to slow the valve opening and closing rather than having a fast opening event followed by a dwell period (at the required lift) then a fast closing event. This can be achieved using PWM control with continuous sensing of the rotor (and therefore valve) position.

It is also possible to drive the rotor at a lower speed if a reduced number of stator coil pairs are employed. A valve motion response is shown in FIG. 27 based on driving four coils. It can be seen that the valve seating velocity has been reduced without affecting the overall valve opening event, demonstrating an optimum level of current usage.

The control system defines a target position to which the valve is to move during each event, itself determined by the instantaneous power required to be generated by the engine, and the control system generated current pulses ensure that the appropriate velocity of the rotor is achieved to reach each target position at the required time.

When a braking pulse is used, the actuator effectively becomes a generator and, according to another preferred feature of the invention, this energy is fed back into the electrical system powering the actuator. Management of the energy flow in this way to allows a 12-volt system to be employed.

Energy reclamation during valve actuation is demonstrated in FIG. 28.

As shown in FIGS. 29(*a*) and (*b*), the actuator has been successfully packaged into the Powertrain 'K' Series engine, in which the valve centres are spaced by 35 mm and the cylinder centres are spaced by 88 mm.

A testing rig demonstrated that all the functional specification requirements can be achieved, with valve events equivalent to crankshaft speeds of up to 8000 rpm in which the opening and closing of a poppet valve has been within 7 ms, with a maximum lift of 10 mm. The rig has included a simulated gas force load of 6 bar, which is representative of a normal road-going four-stroke internal combustion engine.

A valve seating velocity below 240 nm/sec has been achieved using a combination of mechanical and software control strategies.

Valve opening durations for different engine rpm's are depicted in FIG. 30.

Where shorter valve opening durations are required they are achieved by using the oscillatory mode of the actuator. This not only provides shorter valve open durations but can allow reduced valve lift if desired since the opening duration and lift can be defined by the control software.

An embodiment of the actuator described and illustrated herein can deliver 1.5 joules, and 16 such actuators operating the poppet valves of a 16 valve 4 cylinder internal combustion engine have been found to consume 1.6 kW of electrical power.

A 4 cylinder valvetrain using 16 1.5-Joule motors operating at 67 Hz (8040 rpm) and consuming 1.6 KW of electrical power compares very favourably with a mechanical valve train system. 12 volt alternators with an output of 140 Amps giving approximately 7 kW are readily available to provide the required energy.

If vehicle architecture moves towards higher voltage and lower current systems, greater alternator power will become available and the electrical power required will be less of a constraint, allowing further enhancements of the system operation.

The invention has enabled a unique, electromagnetic valve actuation system to be developed, the dimensions of which are compatible with modern, compact, gasoline and diesel engines.

Software control of the current to the actuators, linked to the engine management system and knowledge of the position of each poppet valve at each point in time in each valve event, minimises the current demand on the electrical supply, thereby allowing the system to operate in a 12 volt system.

The reduction in electrical power required has been achieved using a system in which the valve closed and open positions correspond to zero energy usage by the actuator, using power only to trigger the opening and closing of the valve, with energy storage and recovery during each valve event.

The software control combined with the actuators employed herein also enables fully variable valve operation so that each valve is opened by only the amount required for the instant mean operating parameters of the engine, dictated by load and speed, and this will be a major factor in the future development of petrol, diesel & HCCI internal combustion engines.

The invention claimed is:

1. An electromagnetic actuator in which a rotor comprising permanent magnet means is rotatable in a stator which is magnetisable by causing an electric current to flow through at least one winding associated with the stator, wherein:

the rotor is rotatable between stable rest positions;

the rotor is connected to a rigid link by a mechanical linkage by which the rotational movement of the rotor is converted into substantially linear movement of the rigid link, the linkage having a mechanical advantage which varies in a predetermined manner during the rotation of the rotor;

spring means store energy during part of the movement of the rotor and provide kinetic energy for accelerating the rotor during subsequent movement thereof away from rest at a first rest position towards another rest position; and a magnetic torque is exerted on the rotor when a current flows in said at least one winding which is sufficient to overcome the force(s) holding the rotor in the first rest position, to cause the rotor to rotate in a direction from the first rest position towards another rest position, wherein more than two stable rest positions are defined by spring forces acting on the rotor and/or magnetic forces exerted on the rotor by the stator, and the rotor is controllable by application of electric current pulses to the at least one stator winding to rotate from the first rest position to one of the other rest positions and back again, or through said other rest position to return to the first rest position while continuing to rotate in the same direction.

2. An actuator as claimed in claim 1 wherein as energy is stored in spring means associated with a rest position of the rotor, the latter is as a consequence decelerated so that its rotational speed (and therefore also the linear speed of the rigid link and linkage) is progressively reduced as the rotor approaches the rest position.

3. An actuator as claimed in claim 1 wherein the mechanical advantage profile is such that near one rest position angular movement of the rotor results in substantially no linear movement of the rigid link.

4. An actuator as claimed in claim 1 wherein the stator has an even number of poles, and the rotor has an even number of nodes which are magnetised alternately North and South around the rotor by the permanent magnet means.

5. An actuator as claimed in claim 1 wherein the mechanical linkage comprises a lost motion connection between the rotor and the rigid link which is taken up during part of the rotation of the rotor.

6. An actuator as claimed in claim 1 wherein the rotor is prevented from rotating through more than 180° from the first rest position and the rotor movement is oscillatory between two rest positions.

7. An actuator as claimed in claim 1 wherein the rotor can rotate through 360° from the first rest position and the electric current pulses are controlled in use to cause the rotor to pause or slow down as it rotates through the 180° position.

8. An actuator as claimed in claim 1 when employed to open and close an inlet or exhaust valve of an internal combustion engine, wherein the first rest position corresponds to the valve closed position, and the mechanical advantage profile is selected to produce a high mechanical advantage at the rotational position of the rotor at which the valve begins to open, and after initial opening of the valve the profile is such that the mechanical advantage progressively reduces and then progressively increases again until the valve is fully open, and wherein the mechanical advantage again decreases to a minimum and increases again as the rotor rotates towards the first rest position, either in reverse or with continued rotation in the same sense until the rotor approaches the first rest position and the valve is again in its original closed position, beyond which position the rotor continues to rotate without movement being transmitted to the valve due to the lost motion connection, until the rotor reaches the first rest position.

9. An actuator as claimed in claim 1 wherein as the rotor rotates, the permanent magnet means also rotates and produces a magnetic cogging torque as the rotor nodes align with stator poles so as to define the other rest positions for the rotor.

10. An actuator as claimed in claim 1 for opening and closing a valve, wherein the rigid link is connectable to a valve closure member so as to move the latter positively in both opening and closing directions, thereby obviating the need for a separate spring to hold the valve closed.

11. An actuator as claimed in claim 1 in combination with a control system for supplying pulses of electrical energy to the or each winding thereby to provide the required instantaneous electrical energy in each current pulse and/or to control the phase (i.e. timing) and/or the duration of each current pulse, in response to varying engine load, so as to generate sufficient magnetic torque at each instant during valve opening and closing to overcome the forces acting on the valve closure at each point in the engine operating cycle, and which can vary with load, crank angle and from cycle to cycle.

12. An actuator as claimed in claim 1 wherein the stator has eight spaced apart electromagnetically polarisable poles and the rotor has four spaced apart permanently magnetised nodes.

13. An actuator as claimed in claim 1 wherein the stator has four poles, arranged in two opposed pairs, and in use the rotor will normally rest partly aligned with one pair of poles, and an initial movement of the rotor is effected by a pulse of current through at least one winding linked to the stator causing the rotor to be repelled away from the partly aligned poles.

14. An actuator as claimed in claim 1 comprising:

a) a stator with four circularly arranged, inwardly radially directed poles, b) a rotor that includes a pair of diametrically opposed permanent magnet poles, and which is rotatable within the four stator poles through up to 180 degrees from the first rest position to another at the two extremes of its travel, c) a first spring element which stores mechanical energy as the rotor rotates into each of the two extremes of its travel, d) a pin extending laterally from, and parallel to but offset from the axis of rotation of the rotor, e) a lever linked to the pin and pivotally mounted for rotational movement about an axis also parallel to the rotor axis, for exerting thrust externally of the actuator, f) an arcuate slot in the lever in which the pin is received in which it can slide relative to the slot and also transmit rotational movement to the lever, the extent to which angular movement of the pin produces angular movement of the lever being determined by the shape of the slot, g) a second spring element which stores mechanical energy as the lever is rotated into each of the two extremes of its travel, h) at least one winding which when an electric current flows therein will create alternate North and South poles around the four stator poles, i) a housing within which the stator, winding(s), rotor, lever and springs are located, opposite ends of which provide bearings for the rotatable parts, wherein:— j) the shape of the slot is selected so that at one extreme position of the rotor travel, initial rotational or movement of the rotor from that position towards the other results in relative sliding movement between pin and slot before continued rotation of the rotor results in increasing rotational drive being transmitted via the pin to the lever, so that the mechanical advantage during that initial rotational movement of the rotor is substantially greater than the mechanical advantage over the remainder of the rotor travel.

15. An actuator as claimed in claim 1 wherein rotor movement is braked by short-circuiting the windings, causing induced currents to flow in the windings in an opposite sense to the initiating pulse of current, so reversing the stator pole polarity and dissipating kinetic energy of the rotor and any associated linkage.

16. An actuator as claimed in claim 1 wherein braking of the rotor is achieved by reversing the current flow in the windings in order to reverse the direction of torque to decelerate the rotor.

17. An actuator as claimed in claim 1 comprising:— a) a stator of eight circularly arranged, inward radially directed poles, each pole being wound with insulated conductor to produce an electromagnet means at each pole, b) a rotor that includes two pairs of diametrically opposed permanent magnet poles, with the magnetic sense alternating north-south-north-south around the rotor, so that with appropriate polling the rotor is rotatable through 360°, or first in one direction and then back in the opposite direction, c) a spring element that stores mechanical energy as the rotor rotates to the first rest position, d) a pin, surrounded by a tubular wheel element, extending laterally from and parallel to but offset from the axis of rotation of the rotor, e) a first lever pivotally mounted about an axis parallel to the rotor axis, f) an arcuate slot in the first lever within which the wheel and pin are received in which the wheel can roll or slide relative to the slot and also transmit rotational movement to the lever with the mechanical advantage varying with the angular position of the rotor the extent to which the angular movement of the pin and wheel produces angular movement in the lever being determined by the shape of the slot, g) the first lever having a cross-pin joint for transmitting thrust externally of the actuator, h) a sleeve extending from the rotor which is in contact with a second lever, i) the second lever being formed with an arcuate contact surface so as to move the spring via a sliding spherical bearing means, such that the spring displacement is a function of the rotor angular position, j) the arcuate surface of the second lever providing for the first rest position, such that a small angular displacement of the rotor either side of the first rest position results in either no movement of the spring or a slight additional straining of the spring, and such that larger movements of the spring result in the spring progressively unloading until the rotor has moved substantially 180° degrees from the first rest position, and k) a housing within which the stator, windings, rotor lever and spring are located, l) the housing providing bearing means for the rotor, the first lever and the second lever.

18. An actuator as claimed in claim 8 wherein the valve closure member is driven positively in both directions to open and close the valve.

19. An internal combustion engine having at least one exhaust valve when fitted with an actuator as claimed in claim 1 for opening and closing the exhaust valve.

20. An internal combustion engine having a plurality of inlet and exhaust valves when fitted with a corresponding plurality of actuators, each of which is as claimed in claim 1 for independently opening and closing the valve with which it is associated.

* * * * *